US007296765B2

(12) United States Patent
Rodrian

(10) Patent No.: US 7,296,765 B2
(45) Date of Patent: Nov. 20, 2007

(54) AUTOMATIC DISPENSERS

(75) Inventor: James A. Rodrian, Grafton, WI (US)

(73) Assignee: Alwin Manufacturing Co., Inc., Green Bay, WI (US)

( * ) Notice: Subject to any disclaimer, the term of this patent is extended or adjusted under 35 U.S.C. 154(b) by 341 days.

(21) Appl. No.: 10/998,464

(22) Filed: Nov. 29, 2004

(65) Prior Publication Data

US 2006/0175341 A1 Aug. 10, 2006

(51) Int. Cl.
*B65H 63/08* (2006.01)

(52) U.S. Cl. ..... 242/563.2; 242/564.1; 242/565; 222/63

(58) Field of Classification Search ..... 242/564, 242/564.1, 565, 563, 579, 912, 390, 390.2, 242/563.2; 33/733, 750; 222/52, 192, 61, 222/63

See application file for complete search history.

(56) References Cited

U.S. PATENT DOCUMENTS

| | | | |
|---|---|---|---|
| 3,067,364 | A | 12/1962 | Rosso |
| 3,317,150 | A | 5/1967 | Summersby |
| 3,450,363 | A | 6/1969 | Williams |
| 3,505,692 | A | 4/1970 | Forbes |
| 3,669,312 | A | 6/1972 | Kuckens et al. |
| 3,675,051 | A | 7/1972 | Mioduski |
| 3,730,409 | A | 5/1973 | Ratti |
| 3,892,368 | A | 7/1975 | Ricards |
| 3,971,607 | A | 7/1976 | Schnyder |
| 4,119,255 | A | 10/1978 | D'Angelo |
| 4,270,818 | A | 6/1981 | McCabe |
| 4,398,310 | A | 8/1983 | Lienhard |
| 4,449,122 | A | 5/1984 | Whitmer |
| 4,463,426 | A | 7/1984 | Caddick et al. |
| 4,666,099 | A | 5/1987 | Hoffman et al. |
| 4,722,372 | A | 2/1988 | Hoffman et al. |
| 4,738,176 | A | 4/1988 | Cassia |
| 4,765,555 | A | 8/1988 | Gambino |
| 4,786,005 | A | 11/1988 | Hoffman et al. |
| 4,796,825 | A | 1/1989 | Hawkins |
| 4,826,262 | A | 5/1989 | Hartman et al. |

(Continued)

FOREIGN PATENT DOCUMENTS

CA 2294820 5/1999

(Continued)

OTHER PUBLICATIONS

U.S. Appl. No. 60/130,137, filed Apr. 20, 1999, Omdoll et al.

(Continued)

*Primary Examiner*—Peter M. Cuomo
*Assistant Examiner*—William E Dondero
(74) *Attorney, Agent, or Firm*—Jansson Shupe & Munger Ltd.

(57) ABSTRACT

Automatic dispensers for dispensing products such as towel, tissue, wipes, sheet-form materials, soap, shaving cream, fragrances and personal care products. A dispenser includes a housing, an electrical power source, a user input device, a dispensing mechanism, and motor control apparatus. The user input device generates a signal responsive to a user request for product. Motor control apparatus de-powers the dispensing mechanism based on a determination of dispenser conditions representing discharge of the product.

48 Claims, 24 Drawing Sheets

U.S. PATENT DOCUMENTS 4,879,461 A 11/1989 Philipp
4,882,568 A 11/1989 Kyser et al.
4,921,131 A 5/1990 Binderbauer et al.
4,938,384 A 7/1990 Pilolla et al.
4,946,070 A 8/1990 Albert et al.
4,960,248 A 10/1990 Bauer et al.
4,967,935 A 11/1990 Celest
5,031,258 A 7/1991 Shaw
5,060,323 A 10/1991 Shaw
5,086,526 A 2/1992 Van Marcke
5,105,992 A 4/1992 Fender et al.
5,126,078 A 6/1992 Steiner et al.
5,199,118 A 4/1993 Cole et al.
5,217,035 A 6/1993 Van Marcke
5,255,822 A 10/1993 Mease et al.
5,291,534 A 3/1994 Sakurai et al.
5,316,124 A 5/1994 Barnes et al.
5,340,045 A 8/1994 Arabian et al.
5,365,221 A 11/1994 Fennell et al.
5,452,832 A 9/1995 Niada
5,490,722 A 2/1996 Sonnett et al.
5,492,247 A 2/1996 Shu et al.
5,497,326 A 3/1996 Berland et al.
5,514,977 A 5/1996 Agiman
5,555,965 A 9/1996 Mishina
5,573,318 A 11/1996 Arabian et al.
5,625,908 A 5/1997 Shaw
5,632,414 A 5/1997 Merriweather, Jr.
5,651,044 A 7/1997 Klotz, Jr. et al.
5,665,961 A 9/1997 Matzka
5,694,653 A 12/1997 Harald
5,695,091 A 12/1997 Winings et al.
5,730,165 A 3/1998 Philipp
5,772,291 A 6/1998 Byrd et al.
5,781,942 A 7/1998 Allen et al.
5,806,203 A 9/1998 Robinson
5,810,201 A 9/1998 Besse et al.
5,836,482 A 11/1998 Ophardt et al.
5,862,844 A 1/1999 Perrin
5,884,808 A 3/1999 Muderlak et al.
5,915,589 A 6/1999 Lim
5,933,288 A 8/1999 Plesko
5,943,712 A 8/1999 Van Marcke
5,952,835 A 9/1999 Coveley
5,960,991 A 10/1999 Ophardt
5,961,066 A 10/1999 Hambleton
5,988,440 A 11/1999 Saunders et al.
5,992,430 A 11/1999 Chardack et al.
6,000,429 A 12/1999 Van Marcke
6,025,782 A 2/2000 Newham
6,069,354 A 5/2000 Alfano et al.
6,082,419 A 7/2000 Skell et al.
6,098,917 A 8/2000 Cruz
6,105,898 A 8/2000 Byrd et al.
6,119,285 A 9/2000 Kim
6,125,482 A 10/2000 Foster
6,128,826 A 10/2000 Robinson
6,131,587 A 10/2000 Chardack et al.
6,170,241 B1 1/2001 Shibilski et al.
6,178,572 B1 1/2001 Van Marcke
6,189,163 B1 2/2001 Van Marcke
6,195,588 B1 2/2001 Gauthier et al.
6,206,340 B1 3/2001 Paese et al.
6,209,751 B1 4/2001 Goodin et al.
6,209,752 B1 4/2001 Mitchell et al.
6,243,635 B1 6/2001 Swan et al.
6,250,530 B1 6/2001 LaCount et al.
6,262,546 B1 7/2001 Draves et al.
6,269,776 B1 8/2001 Grimsley et al.
6,273,394 B1 8/2001 Vincent et al.
6,283,504 B1 9/2001 Stanley et al.
6,286,240 B1 9/2001 Collins
6,288,707 B1 9/2001 Philipp
6,293,486 B1 9/2001 Byrd et al.
D449,475 S 10/2001 Ehrensperger
6,297,738 B1 10/2001 Newham
6,384,724 B1 5/2002 Landais
6,412,655 B1 7/2002 Stuetzel et al.
6,412,679 B2 7/2002 Formon et al.
6,419,136 B2 7/2002 Formon et al.
6,446,901 B1 9/2002 Haen et al.
6,460,798 B1 10/2002 Haen et al.
6,592,067 B2 7/2003 Denen et al.
6,695,246 B1 2/2004 Elliott et al.
6,710,606 B2 3/2004 Morris
6,742,689 B2 6/2004 Formon et al.
6,745,927 B2 6/2004 Formon et al.
6,766,977 B2 7/2004 Denen et al.
6,793,170 B2 9/2004 Denen et al.
6,820,785 B2 11/2004 Kapiloff
6,830,210 B2 12/2004 Formon et al.
6,838,887 B2 1/2005 Denen et al.
6,854,684 B2 2/2005 Byrd et al.
6,871,815 B2 3/2005 Moody et al.
6,892,620 B2 5/2005 Kapiloff
6,903,654 B2 6/2005 Hansen et al.
2002/0109035 A1* 8/2002 Denen et al. ..... 242/559.1
2002/0175814 A1* 11/2002 Wadlow et al. ..... 340/562
2003/0107341 A1 6/2003 Morris
2003/0167893 A1 9/2003 Morris et al.
2003/0168489 A1 9/2003 Formon et al.
2003/0168550 A1 9/2003 Formon et al.
2003/0222779 A1 12/2003 Schotz et al.
2004/0035976 A1 2/2004 Byrd et al.
2004/0052197 A1 3/2004 Okajima
2004/0133378 A1 7/2004 Todd et al.
2004/0135027 A1 7/2004 Elliott et al.
2004/0160234 A1 8/2004 Denen et al.
2005/0077419 A1 4/2005 Thomas

FOREIGN PATENT DOCUMENTS

CA 2342260 3/2001
DE 19820978 11/1999
EP 1230886 8/2002
EP 1231823 8/2002
EP 1232715 8/2002
GB 2299306 9/1990
WO WO 99/58040 11/1999
WO WO 99/59457 11/1999
WO WO 00/63100 10/2000

OTHER PUBLICATIONS

U.S. Appl. No. 60/159,006, filed Oct. 11, 1999, Omdoll et al.
U.S. Appl. No. 10/963,197, filed Oct. 12, 2004, Rodrian.
Bay West Corporation website excerpt (www.baywestpaper.com) and photograph of Bay West Wave n' Dry dispenser (2 pages). Date: 1997.
Ille Papier-Servvice GmbH product lliterature and excerpts from Ille website (www.ille.de), Undated (7 pages).
U.S. Appl. No. 10/408,970, filed Apr. 8, 2003, Rodrian et al.
U.S. Appl. No. 10/160,863, filed Jun. 3, 2002, Schotz et al.

* cited by examiner

10

35
25
127
129
23
19
33
21
133
109
131
125
31
105
15
137
135
79
51
61
59
13
297
75
19
249
261
43
53
256
259
170
141
89
245
247
57
215
152
193
163
186
213
173
179
191
65
27
185
181
207

AUTOMATIC DISPENSERS

FIELD

The field relates to dispensers and, more particularly, to dispensers for sheet material and personal care products.

BACKGROUND

Automatic dispensers of various types are used to dispense a broad range of products, including, without limitation, towel, tissue, wipes, sheet-form materials, soap, shaving cream, fragrances and personal care products. Automatic dispensers include certain controls provided to make one or more aspects of dispenser operation automatic. Such automatic dispenser controls may include controls provided to initiate a dispense cycle and/or controls provided to regulate dispenser operation during a dispense cycle. There is a need for improvement in these and other aspects of automatic dispenser design and operation.

DETAILED DESCRIPTION

Dispenser 10 embodiments will now be described with reference to the figures. Dispenser 10 shown in the figures is of a type useful in dispensing sheet material in the form of a web of paper towel. Embodiments include dispensers suitable for dispensing dispensable products other than sheet material in the form of paper towel.

Figure 1:
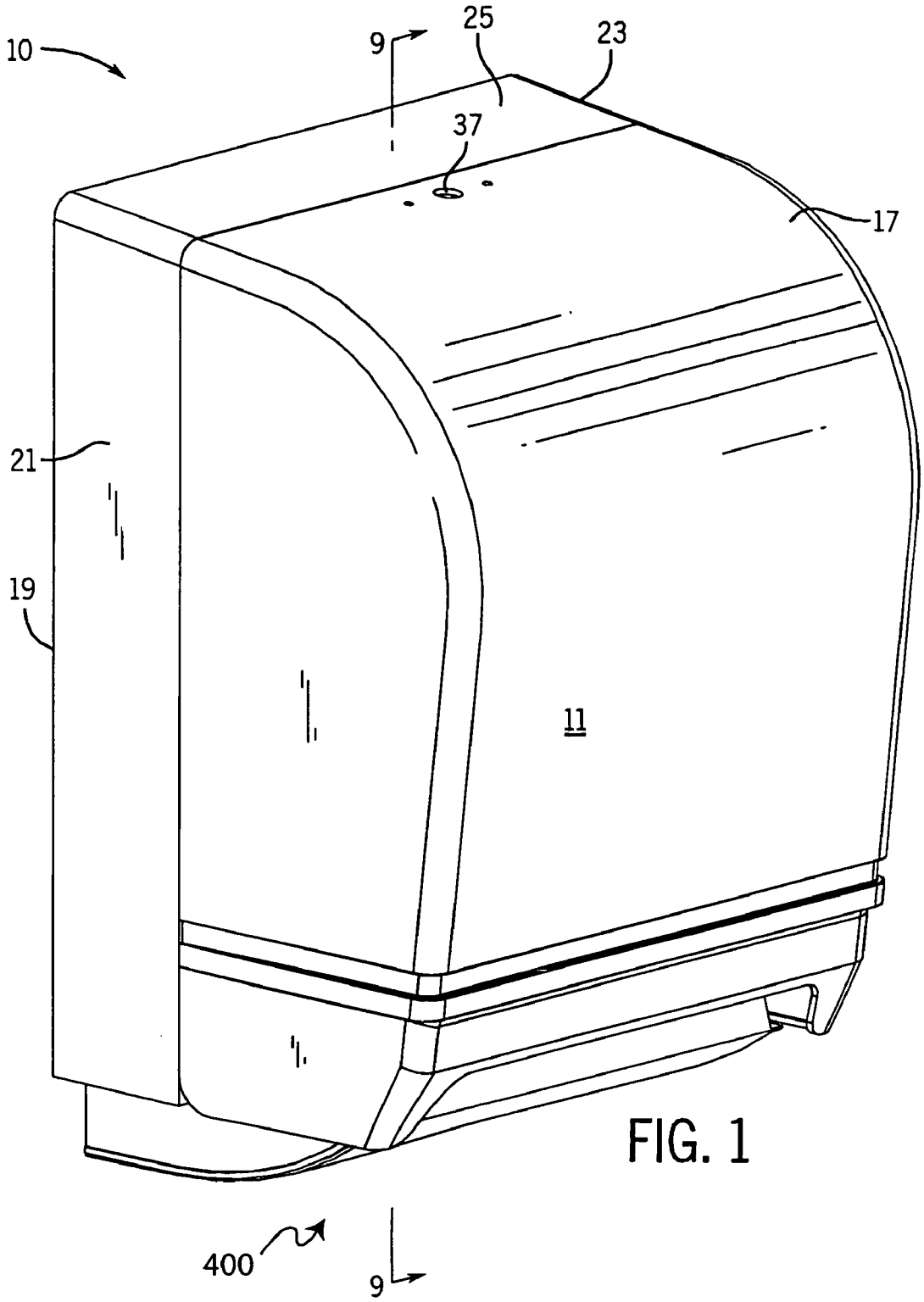
FIG. 1 is a perspective view of an automatic dispenser embodiment.
Figure 2:
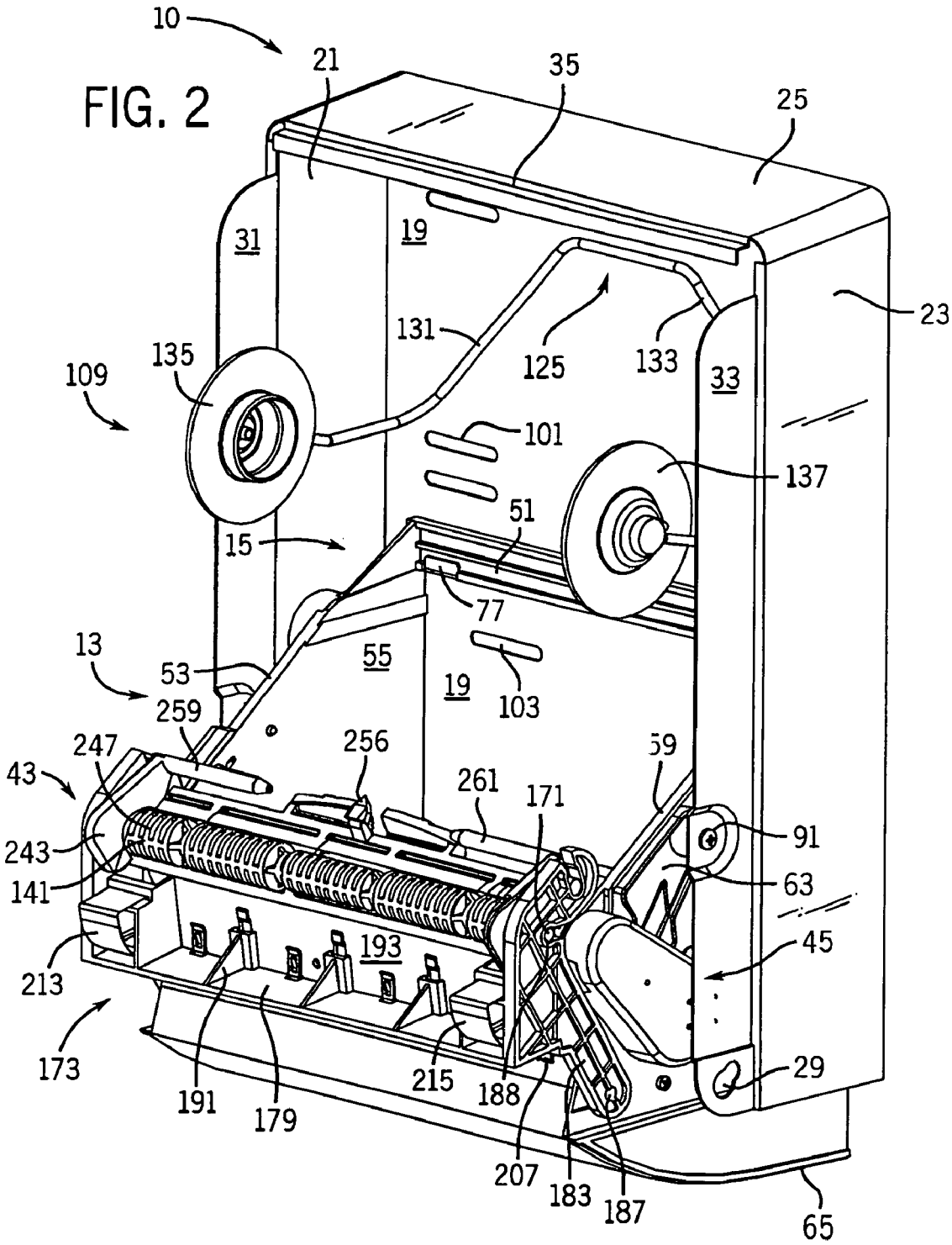
FIG. 2 is a perspective view of the dispenser of FIG. 1 with the housing cover removed.
Figure 3:
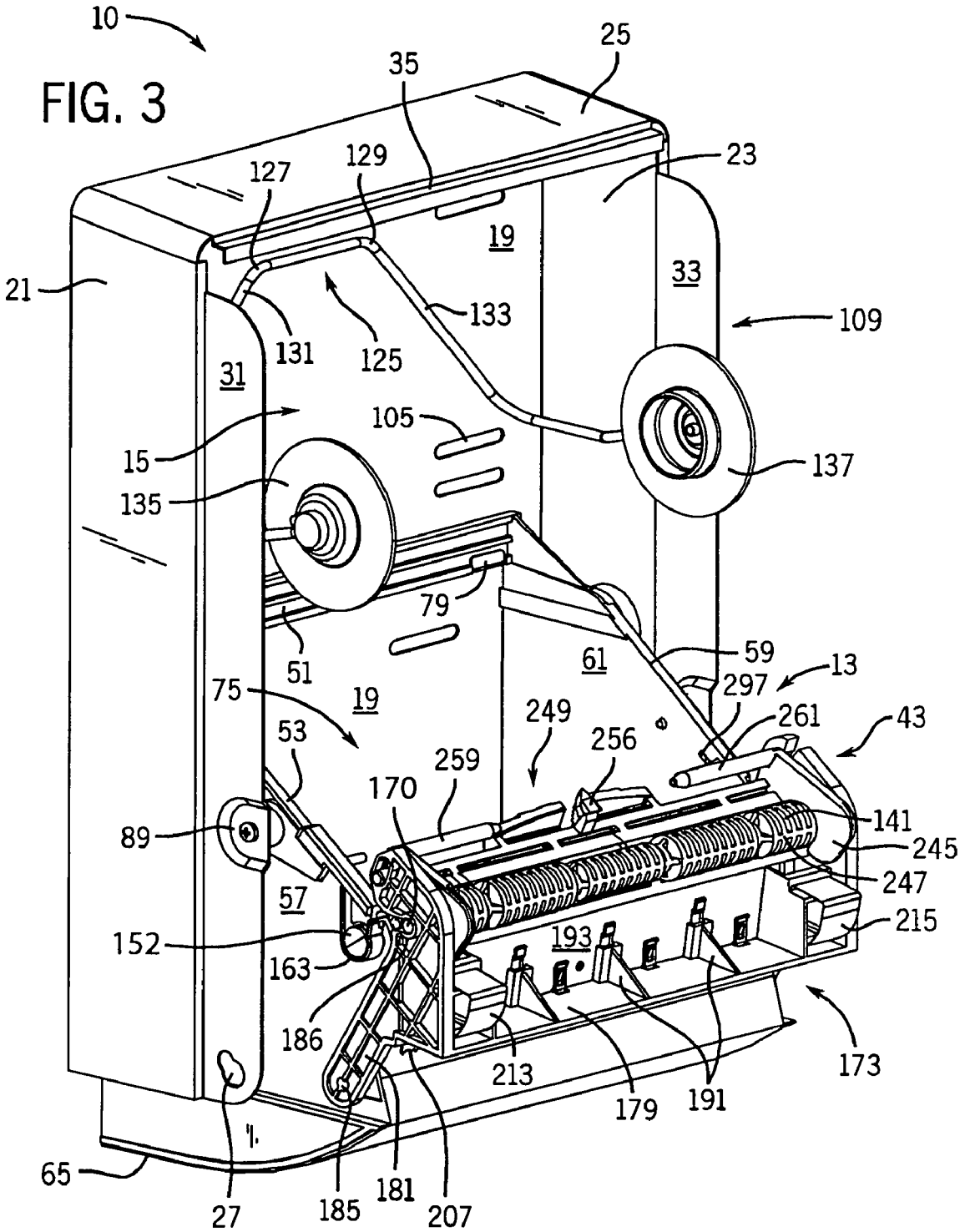
FIG. 3 is another perspective view of the dispenser of FIG. 1 also with the housing cover removed.
Figure 4:
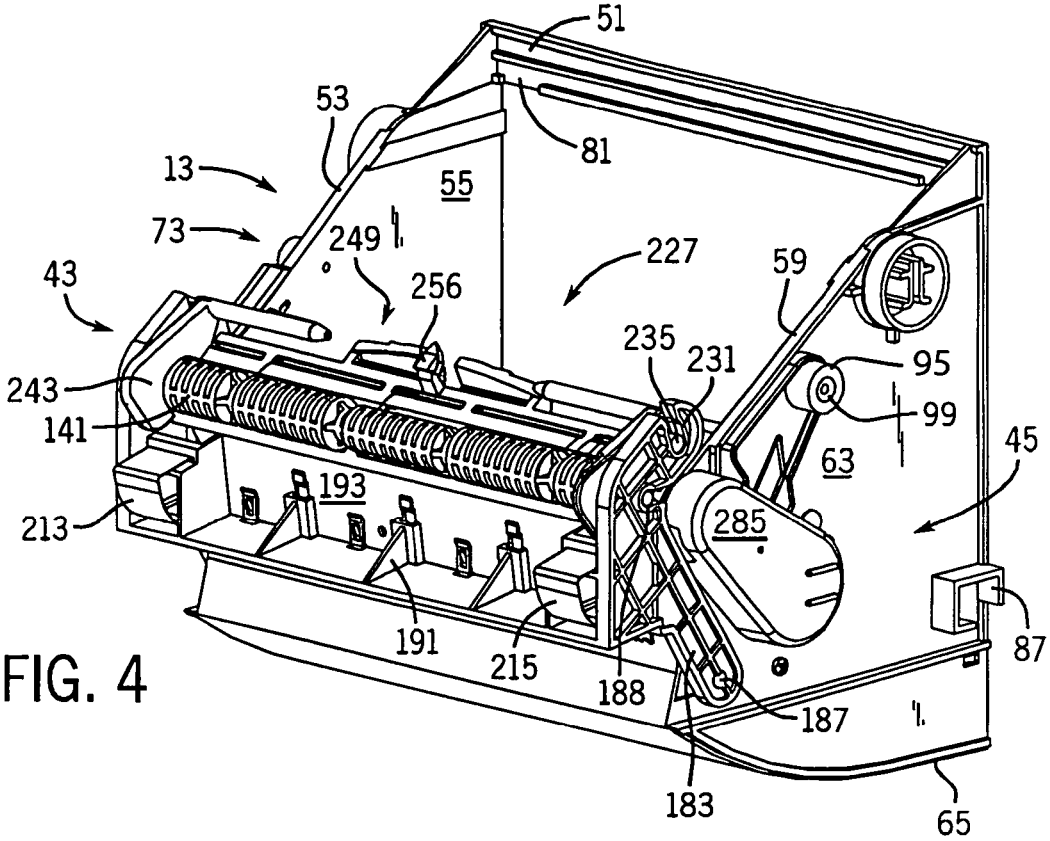
FIG. 4 is a perspective view of the front side of a dispenser frame embodiment.
Figure 5:
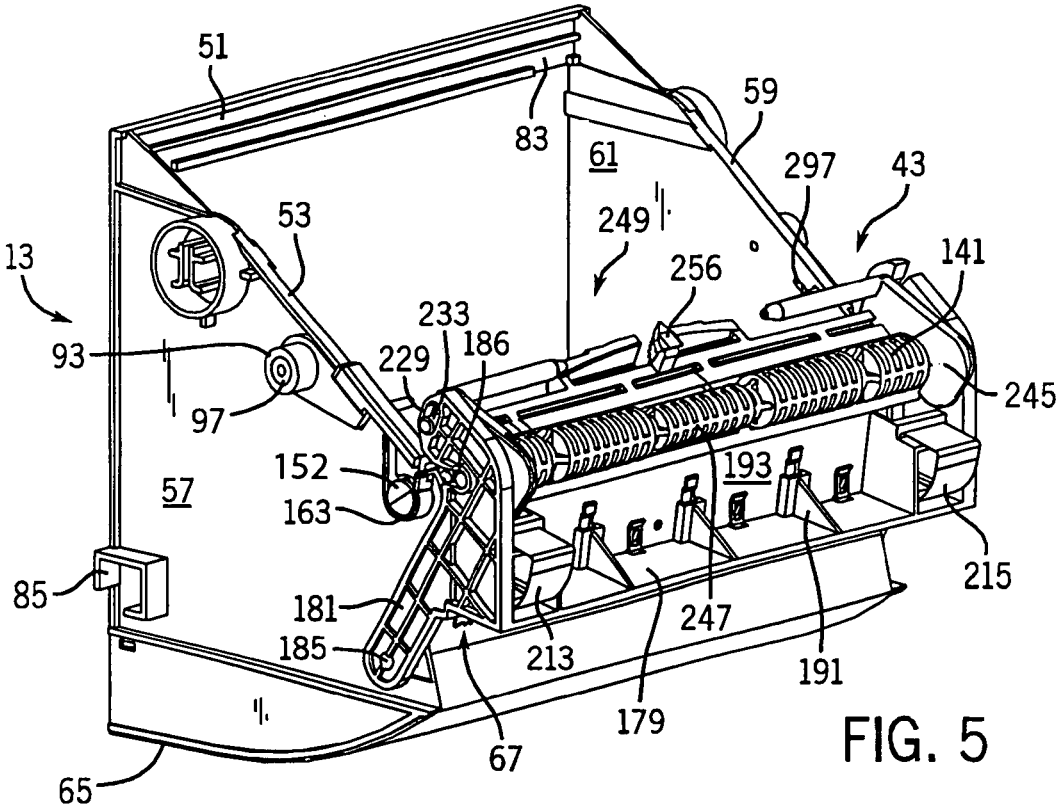
FIG. 5 is another perspective view of the dispenser frame of FIG. 4.
Figure 6:
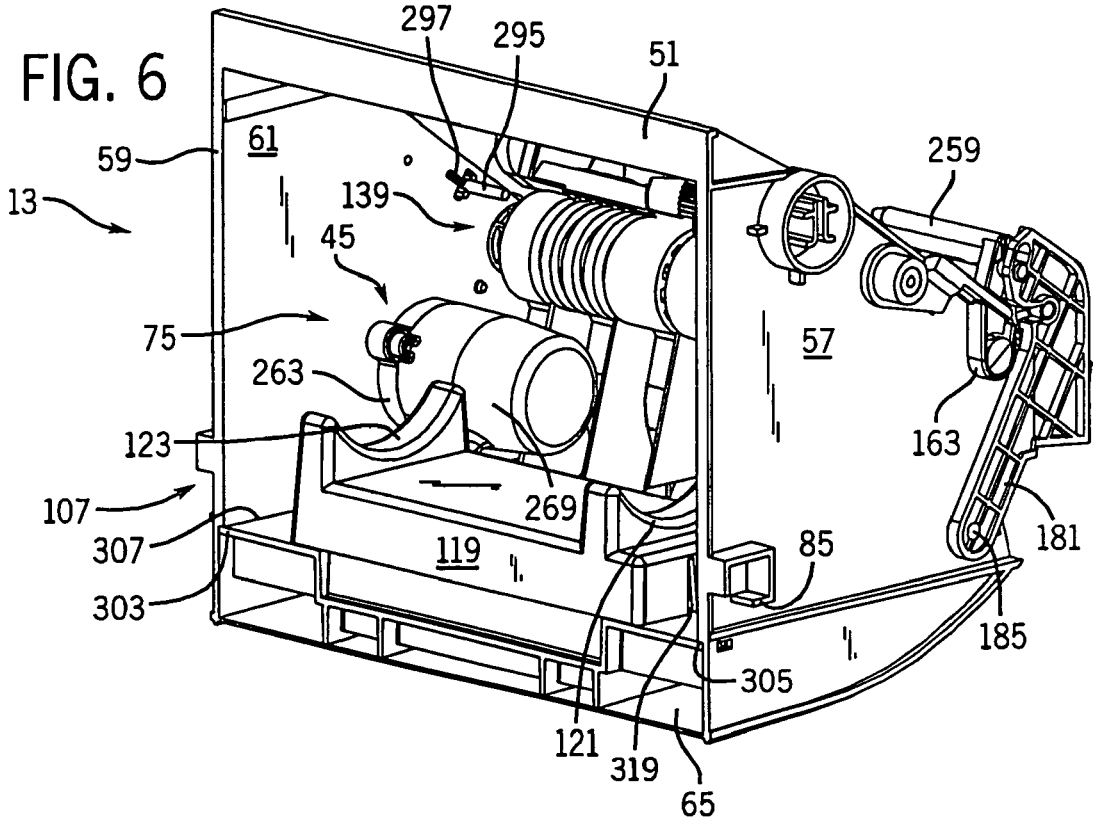
FIG. 6 is a perspective view of the rear side of the dispenser frame of FIG. 4.
Figure 7:
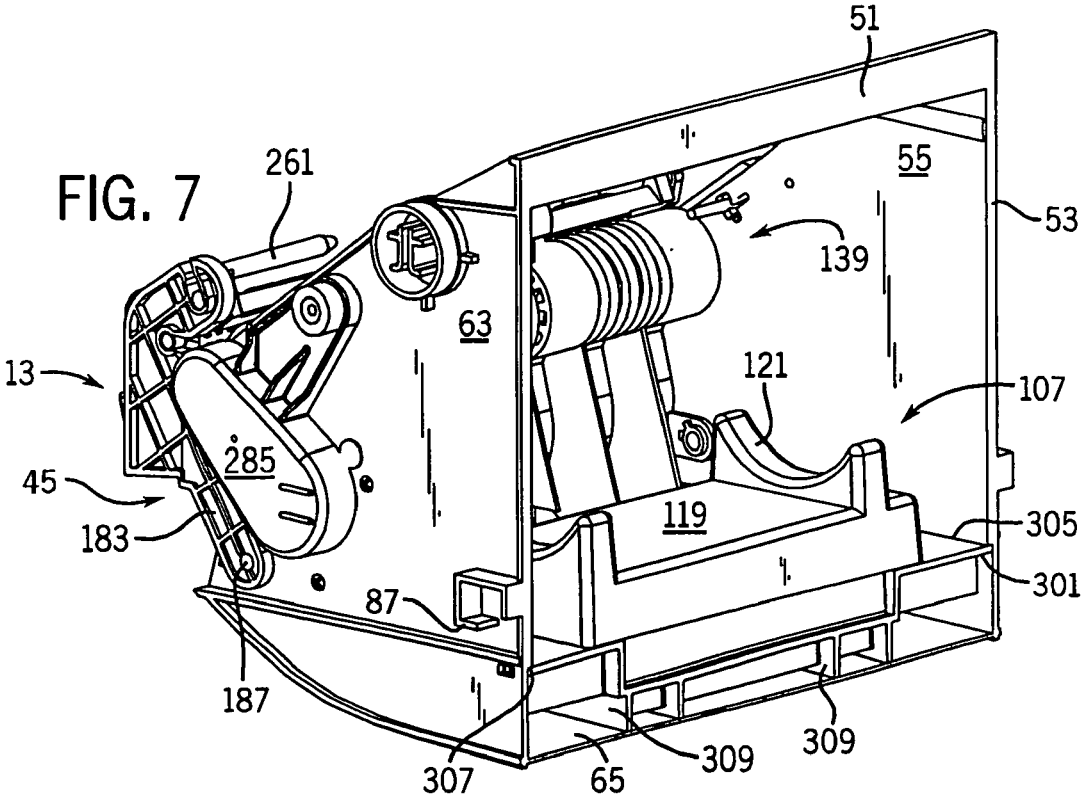
FIG. 7 is another perspective view of the rear side of the dispenser frame of FIG. 4.

Dispenser 10 preferably includes housing 11 and frame 13 mounted within an interior portion 15 of housing 11. Housing 11 may include a front cover 17, rear wall 19, side walls 21, 23 and top wall 25. Cover 17 may be connected to housing 11 in any suitable manner. As shown in FIGS. 1-3, cover 17 is attached for pivotal movement to housing 11 by means of axially aligned pins (not shown) in cover 17 configured and arranged to mate with a respective axially aligned opening 27, 29 provided in housing side walls 21 and 23. Flanged wall surfaces 31, 33, 35 may be provided to extend into cover 17 when the cover 17 is in the closed position shown in FIG. 1 to ensure complete closure of the dispenser 10. A lock mechanism 37 may be provided in cover 17 to prevent unauthorized removal of cover 17. Cover 17 is opened, for example, to load rolls 39, 41 (FIGS. 9-10) of sheet material in the form of a web of paper towel into dispenser 10 or to service dispenser 10. Housing 11 and cover 17 may be made of any suitable material. Formed sheet metal and molded plastic are particularly suitable materials for use in manufacturing housing 11 and cover 17 because of their durability and ease of manufacture.

Frame 13 and preferred components of exemplary dispenser 10 are shown in FIGS. 2 and 3 in which cover 17 is removed from dispenser 10 and in FIGS. 4-8 and 11 in which frame 13 is apart from housing 11. Frame 13 is preferably positioned within a portion of housing interior 15 as shown in FIGS. 2 and 3. Frame 13 is provided to support major mechanical and electrical components of dispenser 10 including dispensing mechanism 43, power supply apparatus 47, proximity detector apparatus 49 and control apparatus 50 (shown in FIGS. 15, 16C-D). Frame 13 is made of a material sufficiently sturdy to resist the forces applied by moving parts mounted thereon. Molded plastic is a highly preferred material for use in manufacture of frame 13.

Frame 13 shown in the figures includes a rear support member 51 (preferred frame 13 does not include a full rear wall), a first sidewall 53 having sidewall inner 55 and outer 57 surfaces, a second sidewall 59 having sidewall inner 61 and outer 63 surfaces and bottom wall 65. Discharge opening 67 is provided between web-guide surface 69 and tear bar 71. Side walls 53 and 59 define frame front opening 73. Housing rear wall 19, frame walls 53, 59, 65 and guide surface 69 define a space 75 in which a stub roll of sheet material 39 can be positioned for dispensing or storage.

Frame 13 is preferably secured along housing rear wall 19 in any suitable manner such as with brackets 77, 79 provided in housing rear wall 19. Brackets 77, 79 mate with corresponding slots 81 and 83 provided in frame rear support member 51. Frame 13 may also be secured in housing 11 by mounting brackets 85, 87 provided along frame sidewall outer surfaces 57, 63 for mating with corresponding brackets (not shown) provided in housing 11. Frame 13 may further be secured to housing 11 by means of fasteners 89, 91 positioned through housing sidewalls 21, 23, bushings 93, 95 and posts 97, 99. Frame 13 need not be a separate component and could, for example, be provided as an integral part of housing 11.

The exemplary dispenser 10 may be mounted on a vertical wall surface (not shown) where dispenser 10 can be easily accessed by a user. As shown particularly in FIGS. 2 and 3, dispenser 10 could be secured to such vertical wall surface by suitable fasteners (not shown) inserted through slotted openings in rear wall 19 of which slots 101, 103, 105 are representative. Of course, dispenser 10 could be configured in manners other than those described herein depending on the intended use of dispenser 10.

Figure 9:
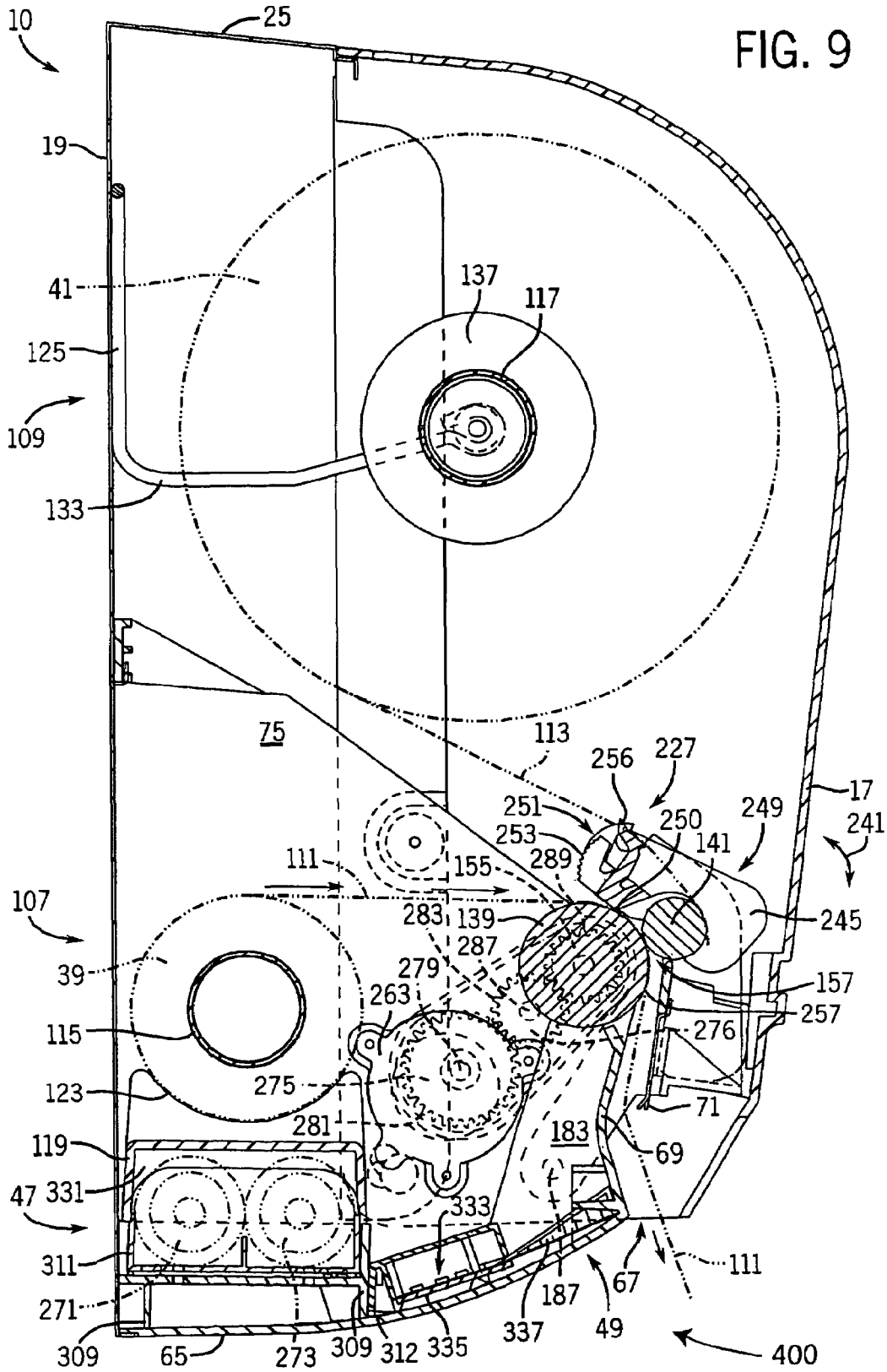
FIG. 9 is a sectional view of the exemplary dispenser taken along section 9-9 of FIG. 1. Sheet material is being dispensed from a stub roll. Certain hidden parts are shown in dashed lines.
Figure 10:
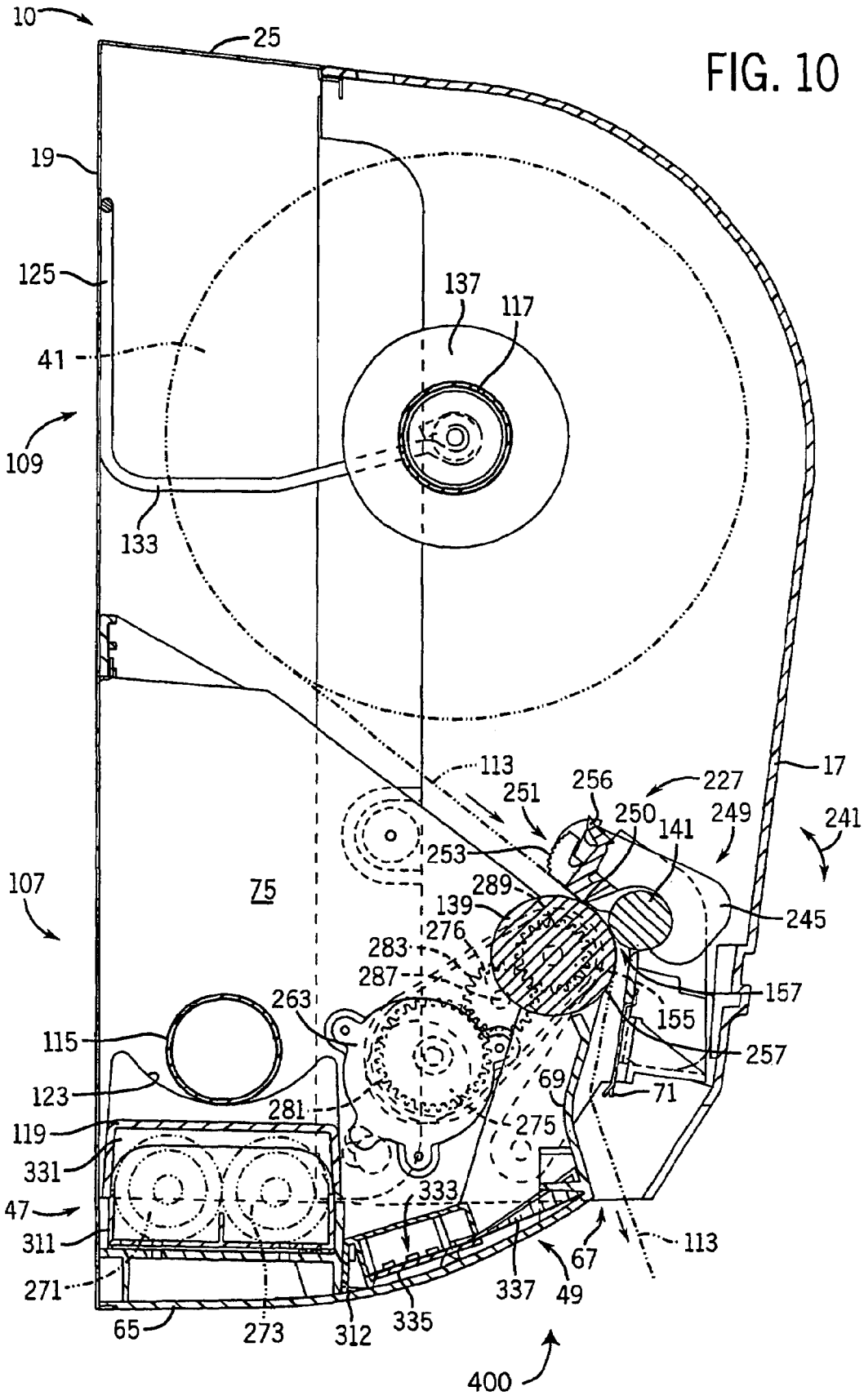
FIG. 10 is a further sectional view of the exemplary dispenser taken along section 9-9 of FIG. 1. Sheet material is being dispensed from a reserve roll. Certain hidden parts are shown in dashed lines.

The exemplary dispenser apparatus 10 includes apparatus 107, 109 for storing primary and secondary sources of sheet material. The sheet material in this example is in the form of primary and secondary rolls 39, 41. Primary roll 39 may be referred to herein as a "stub" roll while secondary roll 41 may be referred to as a reserve roll. A stub roll is a roll which is partially depleted of sheet material wound thereon. Rolls 39, 41 consist of primary and secondary sheet material 111, 113 wound onto a cylindrically-shaped hollow core 115, 117, said core 115, 117 having an axial length and opposed ends (not shown). Such cores 115, 117 are typically made of a cardboard-like material. As shown in FIG. 9, primary or stub roll 39 sheet material 111 is being dispensed while secondary or reserve roll 41 sheet material 113 is in a "ready" position prior to dispensing from that roll 41. FIG. 10 illustrates the dispenser 10 following a transfer event in which sheet material 113 from reserve roll 41 is transferred to the nip 157 for dispensing from the dispenser 10 following depletion of stub roll 39 sheet material 111.

It is very highly preferred that the rolls 39, 41 are stored in and dispensed from housing interior 15. However, there is no absolute requirement that such rolls be contained within housing interior 15 or space 75.

Turning now to the preferred apparatus 107 for storing primary or stub web roll 39, such storing apparatus 107 includes cradle 119 with arcuate support surfaces 121, 123 against which the primary roll 39 rests. Surfaces 121, 123 are preferably made of a low-friction material permitting roll 39 to freely rotate as sheet material 111 is withdrawn from roll 39.

Referring further to FIGS. 2-3 and 9, there is shown a preferred apparatus 109 for storing secondary web roll 41. Storing apparatus 109 includes yoke 125 attached in a suitable manner to housing rear wall 19, such as by brackets 127, 129 formed around yoke 125. Yoke 125 comprises arms 131, 133 and web roll holders 135, 137 mounted on respective arms 131, 133. Arms 131 and 133 are preferably made of a resilient material so that they may be spread apart to receive respective ends of hollow core roll on which the secondary sheet material web is wound.

Persons of skill in the art will appreciate that support structure, other than cradle 119 and yoke 125 could be used to support rolls 39, 41. By way of example only, a single removable rod (not shown) spanning between walls 53, 59 or 21, 23 could be used to support rolls 39, 41. As a further example, roll 39 could simply rest on frame bottom wall 65 without support at ends of the core 115. Dispenser 10 may be configured to dispense solely from a single source of sheet material.

A preferred dispensing mechanism 43 for feeding sheet material 111, 113 from respective rolls 39, 41 and out of dispenser 10 will next be described. Such dispensing mechanism 43 comprises drive roller 139, tension roller 141, drive motor 267 and the related components as hereinafter described and as shown particularly in FIGS. 2-10.

Drive roller 139 is rotatably mounted on frame 13. Drive roller may include a plurality of longitudinally spaced apart drive roller segments 143, 145, 147 on a shaft 149. Drive roller 139 includes ends 151, 153 and drive gear 155 rigidly connected to end 153. Drive gear 155 is part of the dispensing mechanism 43 which rotates drive roller 139 as described in more detail below. Segments 143-147 rotate with shaft 149 and are preferably made of a tacky material such as rubber or other frictional materials such as sandpaper or the like provided for the purpose of engaging and feeding sheet material 111, 113 through a nip 157 between drive and tension rollers 139, 141 and out of the dispenser 10 through discharge opening 67.

Shaft end 153 is inserted in bearing (for example, a nylon bearing) 159 which is seated in opening 161 in frame side wall 59. Stub shaft 152 at shaft end 151 is rotatably seated on bearing surface 163 in frame first side wall 53 and is held in place by arm 167 mounted on post 97.

A plurality of teeth 169 may be provided to extend from guide surface 69 into corresponding annular grooves 172 around the circumference of drive roller outer surface 257. The action of teeth 169 in grooves 172 serves to separate any adhered sheet material 111, 113 from the drive roller 139 and to direct that material through the discharge opening 67.

Figure 8:
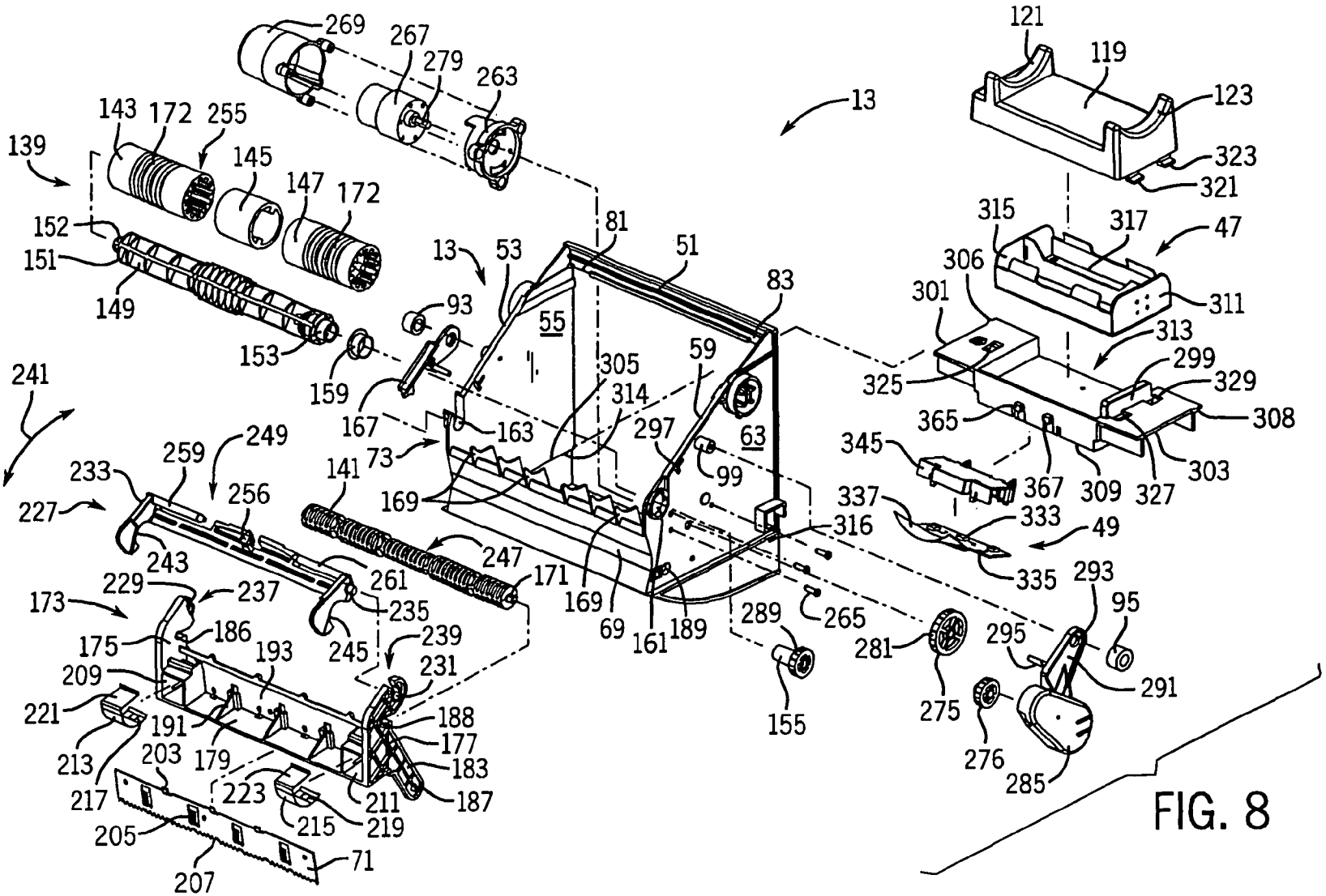
FIG. 8 is an exploded perspective view of a dispenser frame and certain preferred mechanical components.

The tension roller 141 is mounted for free rotation, preferably on a roller frame assembly 173. Tension roller 141 cooperates with drive roller 139 to form nip 157 and to maintain tension on the sheet material 111, 113 enabling the sheet material 111, 113 to be unwound from the respective roll 39, 41 during a dispense cycle. Roller frame assembly 173 may include spaced apart side wall members 175, 177 interconnected by a bottom plate 179. Roller frame assembly 173 may also be provided with arm extensions 181, 183 having axially-oriented inwardly facing posts 185, 187 which extend through coaxial pivot mounting apertures in frame sidewalls 53, 59, one of which 189 is shown in FIG. 8 (the other identical aperture is hidden behind guide surface 69) pivotally mounting roller frame assembly 173 to frame 13. Reinforcement members, such as member 191, may extend from the bottom plate 179 to an upstanding wall 193. In the embodiment, bearing surfaces 186, 188 are located at the top of the side walls 175, 177 to receive respective stub shafts 170, 171 of tension roller 141 as described in detail below.

A tear bar 71 is provided to facilitate user tearing of the sheet material 111, 113 into discrete sheets. Other cutting arrangements may be provided, such as a guillotine cutter or a cutter which extends and retracts from drive roller 139 of the type shown in commonly owned U.S. Pat. No. 6,446,901 hereby incorporated by reference. The tear bar 71 shown is either mounted to, or is integral with, the bottom of the roller frame assembly 173. The tear bar 71 may be provided with tabs 203 and clips 205 for attachment to the bottom of the roller frame assembly 173 if the tear bar 71 is not molded as part of the roller frame assembly 173. A serrated edge 207 is at the bottom of tear bar 71 for cutting and separating the sheet material 111, 113 into discrete sheets.

Roller frame assembly 173 may further include spring mounts 209, 211 at both sides of roller frame assembly 173. Leaf springs 213, 215 are secured on mounts 209, 211 facing forward with bottom spring leg 217, 219 mounted in a fixed-position relationship with mounts 209, 211 and upper spring leg 221, 223 being mounted for forward and rearward movement. Cover 17, when in the closed position of FIG. 1, urges springs 213, 215 and roller assembly 173 rearwardly thereby urging tension roller 141 firmly against drive roller 139. Springs 213, 215 also enable roller frame assembly 173 to move away from drive roller 139 so that the tension roller 141 "rides over" any irregular (i.e., crumpled or folded) portions of sheet material 111, 113 thereby preventing any potential paper jam condition.

An optional transfer assembly 227 may be provided if it is desired to dispense from plural sources of sheet material 111, 113. Transfer assembly 227 is provided to automatically feed the secondary sheet material 113 into the nip 157 upon exhaustion of the primary sheet material 111 thereby permitting the sheet material 113 from roll 41 to be dispensed. The transfer assembly 227 shown is mounted interior of tension roller 141 on bearing surfaces 229, 231 of the roller frame assembly 173. The transfer assembly 227 is provided with a stub shaft 233 at one end in bearing surface 229 and a stub shaft 235 at the other end in bearing surface 231. Each bearing surface 229, 231 is located at the base of a vertically-extending elongate slotted opening 237, 239. Each stub shaft 233, 235 is loosely supported in slots 237, 239. This arrangement permits transfer assembly 227 to move in a forward and rearward pivoting manner in the direction of dual arrows 241 and to translate up and down along slots 237, 239, both types of movement being provided to facilitate transfer of sheet material 113 from secondary roll 41 into nip 157 after depletion of sheet material 111 from roll 39 as described below.

As stated, in the embodiment shown, the transfer assembly 227 is mounted for forward and rearward pivoting movement in the directions of dual arrows 241. Pivoting movement of transfer assembly 227 in a direction away from drive roller is limited by hooks 243, 245 at opposite ends of transfer assembly 227. Hooks 243, 245 are shaped to fit around tension roller 141 and to correspond to the arcuate surface 247 of tension roller 141.

Referring to FIG. 9, a transfer mechanism 249 is generally and preferably positioned in a central location of the transfer assembly 227. Transfer mechanism 249 includes a drive roller contact surface 250, an arcuate portion 251 with outwardly extending teeth 253 which are moved against drive roller arcuate surface 257 during a transfer event as described below. A catch 256 is provided to pierce and hold the secondary sheet material 113 prior to transfer of the sheet material to the nip 157. Opposed, inwardly facing coaxial pins 259, 261 (see FIG. 8) are mounted on respective ends of transfer assembly 227 also to hold the secondary sheet material 113 prior to transfer to the nip 157. Operation of transfer assembly 227 will be described in more detail below.

The drive and tension rollers 139, 141, roller frame assembly 173, transfer assembly 227 and related components may be made of any suitable material. Molded plastic is a particularly useful material because of its durability and ease of manufacture.

Referring now to FIGS. 3-4, 6-9 and 11, there are shown preferred motor and power transmission related components of preferred drive mechanism 43. A motor mount 263 is mounted to inside surface 61 of frame side wall 59 by fasteners of which screw 265 is exemplary. A direct current geared motor 267 is attached to mount 263. A suitable DC geared motor is the model 25150-50 motor available from Komocon Co. Ltd. of Seoul, Korea. Motor 267 may be enclosed by motor housing 269 mounted over motor 267 to mount 263. Motor 267 is preferably powered by four series-connected 1.5 volt D-cell batteries, two of which 271, 273 are shown in FIGS. 9 and 10. Optionally, motor 267 may be powered by direct current from a low-voltage AC to DC transformer (not shown).

In the embodiment, motor 267 drives a power transmission assembly consisting of input gear 275 intermediate gear 276, and drive gear 155. Input gear 275 is mounted on motor shaft 279. Input gear teeth 281 mesh with teeth 283 of intermediate gear 276 which is rotatably secured to housing 285 by a shaft 287 extending from housing 285. Teeth 283 in turn mesh with drive gear teeth 289 to rotate drive gear 155 and drive roller 139.

Housing 285 covers gears 155, 275 and 276 and is mounted against side wall outer surface 63 by armature 291 having an opening 293 fitted over post 99. Bushing 95 secured between walls 23 and 59 by fastener 91 urges armature 291 against side wall outer surface 63 holding housing 285 in place. Further support for housing 285 is provided by pin 295 inserted through mating opening 297 in side wall 59. Any suitable motor and power transmission arrangement may be used to power drive roller 139. For example, motor 267 may be in a direct drive relationship with drive roller 139.

FIGS. 6-10 show a preferred power supply apparatus 47 for supplying electrical power to motor 267. Power supply apparatus 47 has a power source output which may be the voltage or current produced by the power supply apparatus 47. While the preferred power supply apparatus 47 is described in connection with dry cell batteries, such as batteries 271, 273, it is to be understood that other types of power sources may be used. Such power sources could include low voltage DC power from a transformer or power from photovoltaic cells or other means.

In the embodiment, base 299 is mounted in frame 13 by mechanical engagement of base end edge surfaces 301, 303 with corresponding flanges 305, 307 provided along inner surfaces 55, 61 of respective walls 53, 59 and by engagement of tabs 306, 308 with slots 314, 316 also provided in walls 53, 59. Tabs 310, 312 (see FIG. 12) protruding from frame bottom wall 65 aid in locating base 299 by engagement with base bottom edge 309. Base 299 and frame 13 components are sized to permit base 299 to be secured without fasteners.

Battery box 311 is received in corresponding opening 313 of base 299 and may be held in place therein by any suitable means such as adhesive (not shown) or by fasteners (not shown). Battery box 311 is divided into two adjacent compartments 315, 317 each for receiving two batteries, such as batteries 271, 273, end to end in series connection for a total of four batteries. Positive and negative terminals and conductors (not shown) conduct current from the batteries to the drive, detector and control apparatus 45, 49 and 50.

Cradle 119 is removably attached to base 299 by means of tangs 319, 321, 323 inserted through corresponding openings 325, 327, 329 in base 299. Cradle 119 includes a hollow interior portion 331 corresponding to the profile of battery box 311. Cradle 119 receives battery box 311 therein when cradle 119 is attached to base 299. Tangs 319-323 are made of a resilient material permitting them to be urged out of contact with base 299 so that cradle 119 may be removed to access battery box 311, for example to place fresh batteries (i.e., 271, 273) into battery box 311.

The mechanical structure of a preferred proximity detector apparatus 49 will be now be described particularly with respect to FIGS. 8-13. The proximity detector 49 is a form of a user input device. A user input device is defined as a device by which the user's request for dispensing of product is input to the dispenser 10. A proximity detector 49 is one such device as is a simple pushbutton contact switch. Proximity detector 49 comprises circuit components 333 mounted on printed circuit board 335 ("PC board") and a sensor 337 comprising first and second conductors 339, 341 deposited on substrate 343. The circuit components 333 shown in the drawings are stylized and are provided for illustrative purposes only. Components 333 do not represent the actual components utilized in dispenser 10. A detailed description of the actual circuit components and circuit operation will be provided below with respect to FIGS. 15-19F.

Figure 11:
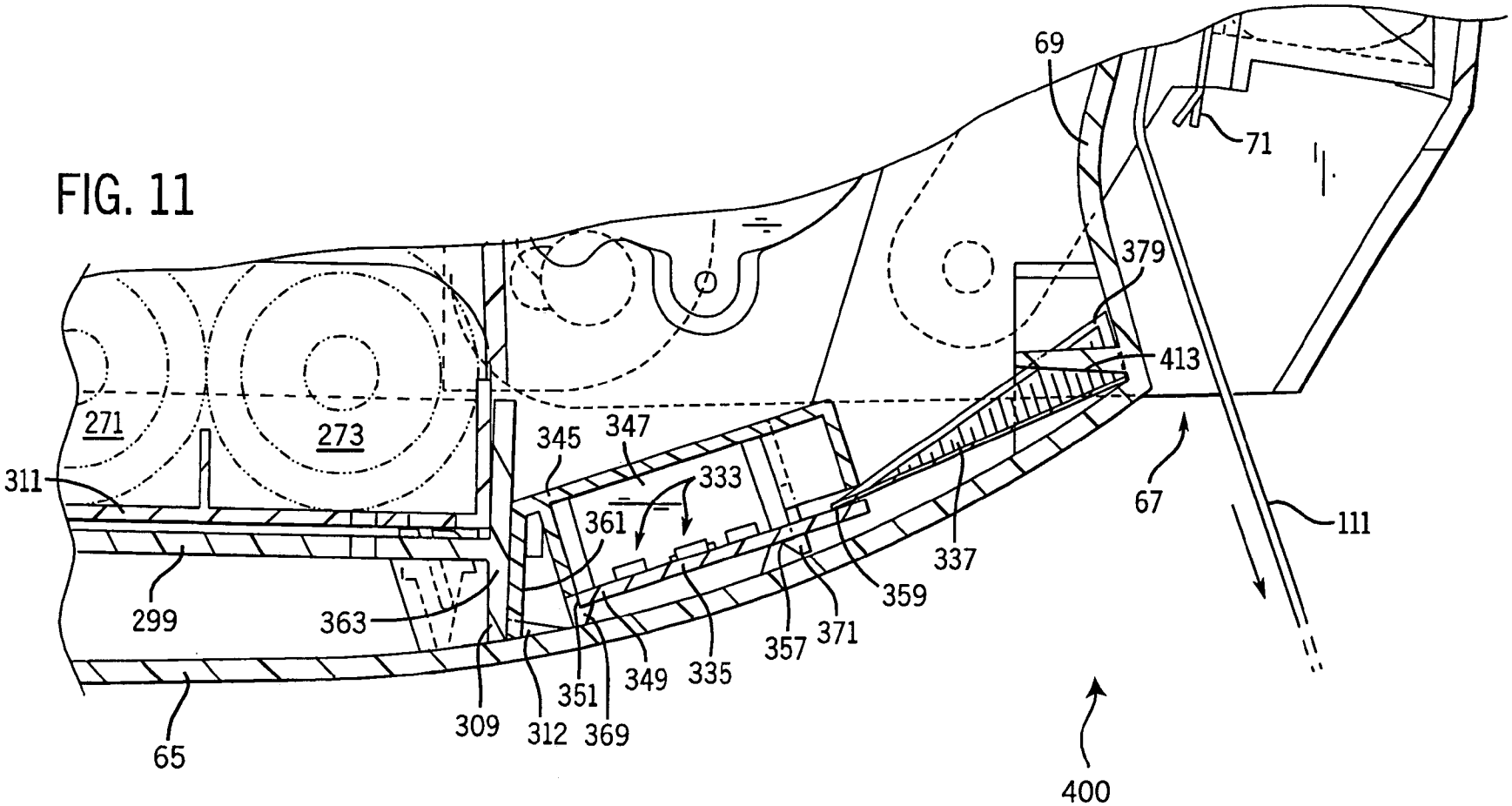
FIG. 11 is an enlarged partial sectional view of the exemplary dispenser of FIGS. 9 and 10. Certain hidden parts are shown in dashed lines.

PC board 335 on which components 333 are mounted is preferably a rigid resin-based board with electrical conductors (not shown) deposited thereon between the appropriate components 333 as is typical of those used in the electronics industry. PC board 335 is mounted in frame 13 by any suitable arrangement. Housing 345 has a hollow interior space 347 in which components 333 are received. PC board rear edge 349 is inserted in slot 351 and front edges of PC board 353, 355 are inserted in co-planar housing slots, one of which 357, is shown in FIG. 11 and the other of which is a mirror image of slot 357. Housing 345 includes a front opening 359 through which substrate 343 extends out of housing 345 toward the front of the dispenser 10. As best shown in FIGS. 8-11, housing 345 is held in place along frame bottom wall 65 with housing rear wall 361 abutting base front wall 363 with tangs 365, 367 engaged with corresponding openings (not shown) in housing rear wall 361. Housing front and rear legs 369, 371 rest on frame bottom wall 65.

Substrate 343, is preferably made of a thin flexible material, such as MYLAR®, polyamide, paper or the like for a purpose described in detail below. By way of example only, a preferred substrate thickness may be approximately 0.008" thereby permitting the substrate to be shaped. Substrate 343 is initially die-cut, preferably in a trapezoidal configuration best shown in FIGS. 12-14. Substrate 343 is provided with a front edge 373, a center 375, front corners 377, 379, side edges 381, 383, rear edge 385, and top 387 and bottom 389 surfaces. Substrate 343 is mechanically fastened along rear edge 385 to PC board 335 by solder joints at terminals 403, 405. An adhesive or mechanical fasteners could additionally be provided to further join substrate 343 to PC board 335.

Figure 12:
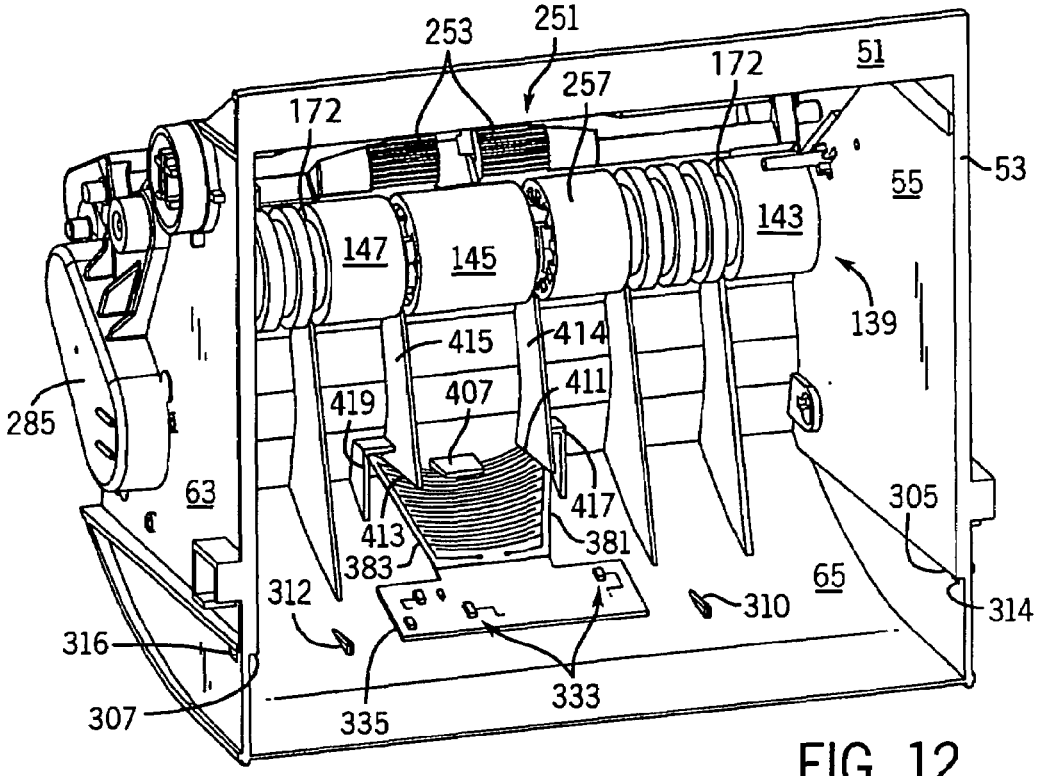
FIG. 12 is a rear perspective view of the rear side of the dispenser frame of FIG. 4 showing an exemplary three-dimensional sensor and the location at which the sensor is positioned within the dispenser. Certain parts are removed from the dispenser. The electrical components shown are illustrative only and are not intended to represent the actual components.
Figure 13:
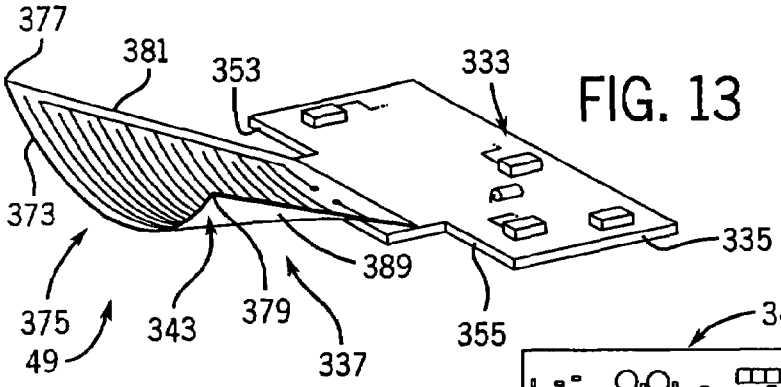
FIG. 13 is a perspective view the exemplary three-dimensional sensor of FIG. 12. The electrical components shown are illustrative only and are not intended to represent the actual components.
Figure 14:
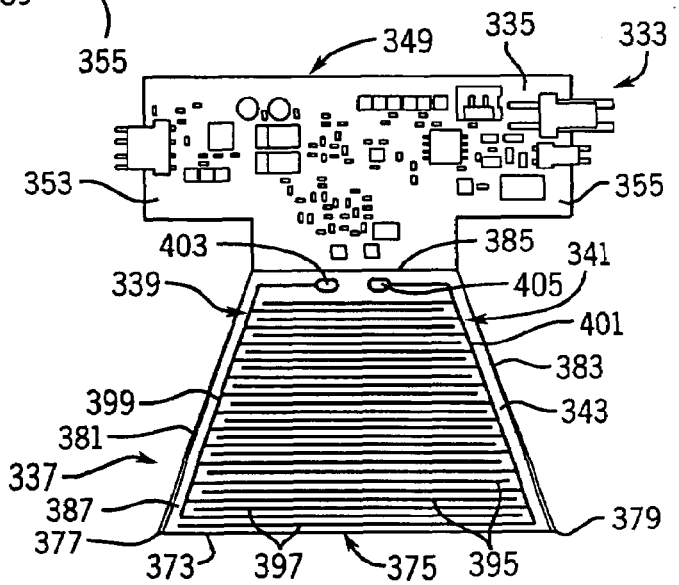
FIG. 14 is a top plan view of the exemplary three-dimensional sensor of FIG. 12. The electrical components shown are illustrative only and are not intended to represent the actual components.

Referring to FIGS. 12-14, sensor 337 consists of first and second conductors 339, 341 made of electrically-conductive copper or the like deposited on substrate 343. Conductors 339, 341 are preferably deposited in the interdigital array shown in FIGS. 12-14. Specifically, first and second conductors 339, 341 each preferably include a plurality of parallel conductor elements 395, 397 deposited on substrate 343, each connected to respective main conductors 399, 401 which end in terminals 403, 405. Each parallel element 395, 397 is connected such that each element 395 of the first conductor 339 is connected to every other first conductor element 395 and each element 397 of the second conductor 341 is connected to every other second conductor element 397. Further, the parallel elements 395, 397 of each conductor 339, 341 are preferably arrayed such that elements 395, 397 alternate one after the other so that the nearest element 397 to each element 395 is an element 397 of the second conductor 341 and the nearest element 395 to each element 397 is an element 395 of the first conductor 399.

Sensor 337 generates a detection zone 400 (FIGS. 1, 9-11) directed toward positions about dispenser 10 most likely to be reached by the outstretched hand or body part of user positioned to receive sheet material 111, 113 from web discharge opening 67. Substrate 343 and conductors 339, 341 may take on an arcuately-shaped configuration by bending the flexible substrate 343 and conductors 339, 341 such that substrate front corners 377, 379 and side edges 381, 383 are positioned above center portion 375 as shown in FIGS. 12-14. Clip 407 holds substrate 343 along the front edge 373 center portion 375. Slots 411, 413 in ribs 414, 415 are above clip 407 and receive the substrate 343 therein. Front corners 377, 379 are held against walls 417, 419 at a position above slots 411, 413. Conductors 339, 341 take on the three-dimensional configuration of substrate 343.

Sensor 337 need not have a three-dimensional structure such as described herein. Sensor 337 may be flat, for example mounted on a flat substrate 343 having conductors 339, 341 deposited on the flat substrate 343.

Forms of user input devices other than the touchless proximity detector 49 may be used. By way of example, a simple momentary contact switch (not shown) located at a suitable position on dispenser housing 11 could be used to sense a user's request for dispensing of a length of sheet material. As is known, a contact switch generates an output responsive to being pushed by a user.

Figure 15:
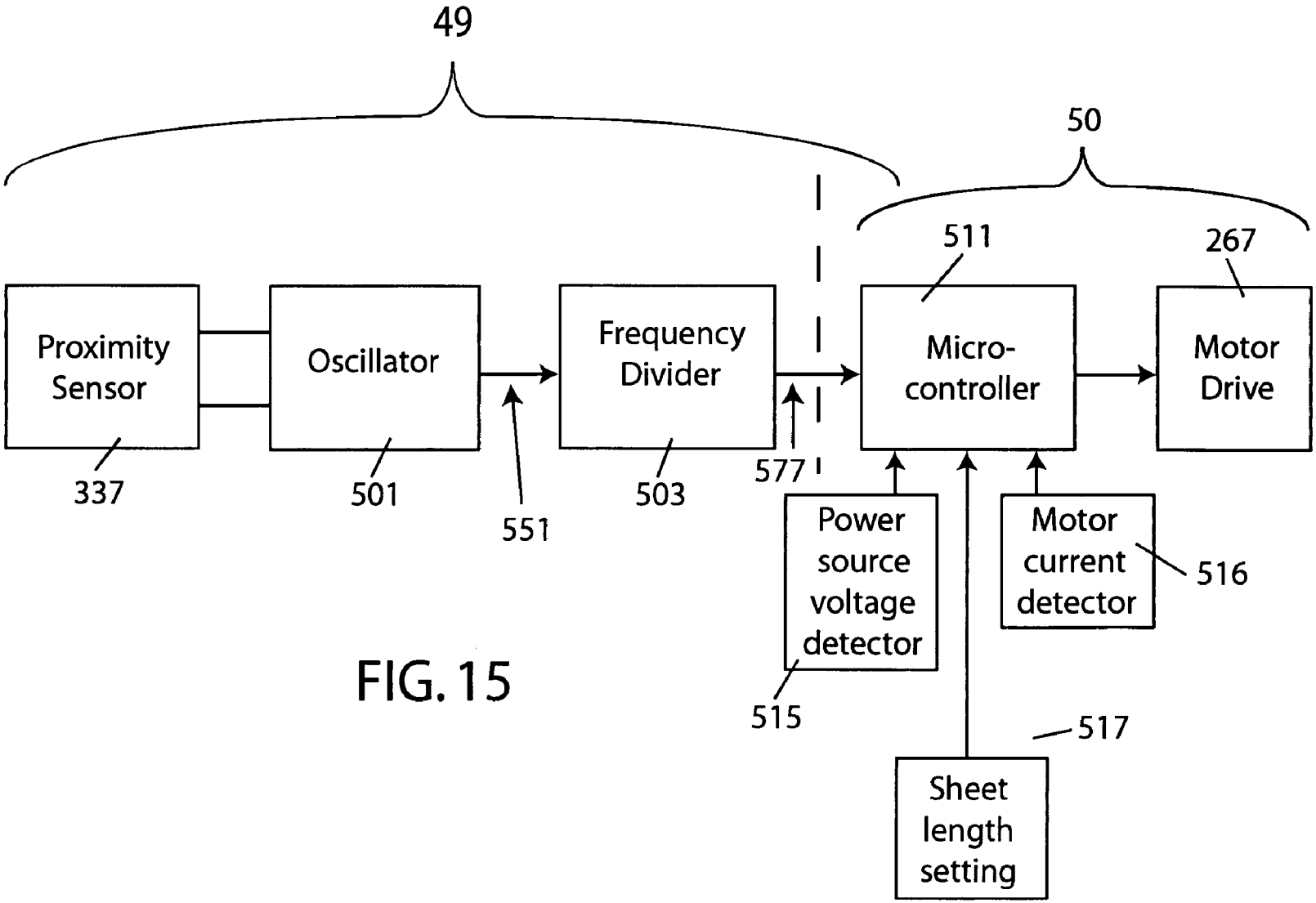
FIG. 15 is a block diagram illustrating components of exemplary proximity detector and control apparatus embodiments.
Figure 17:
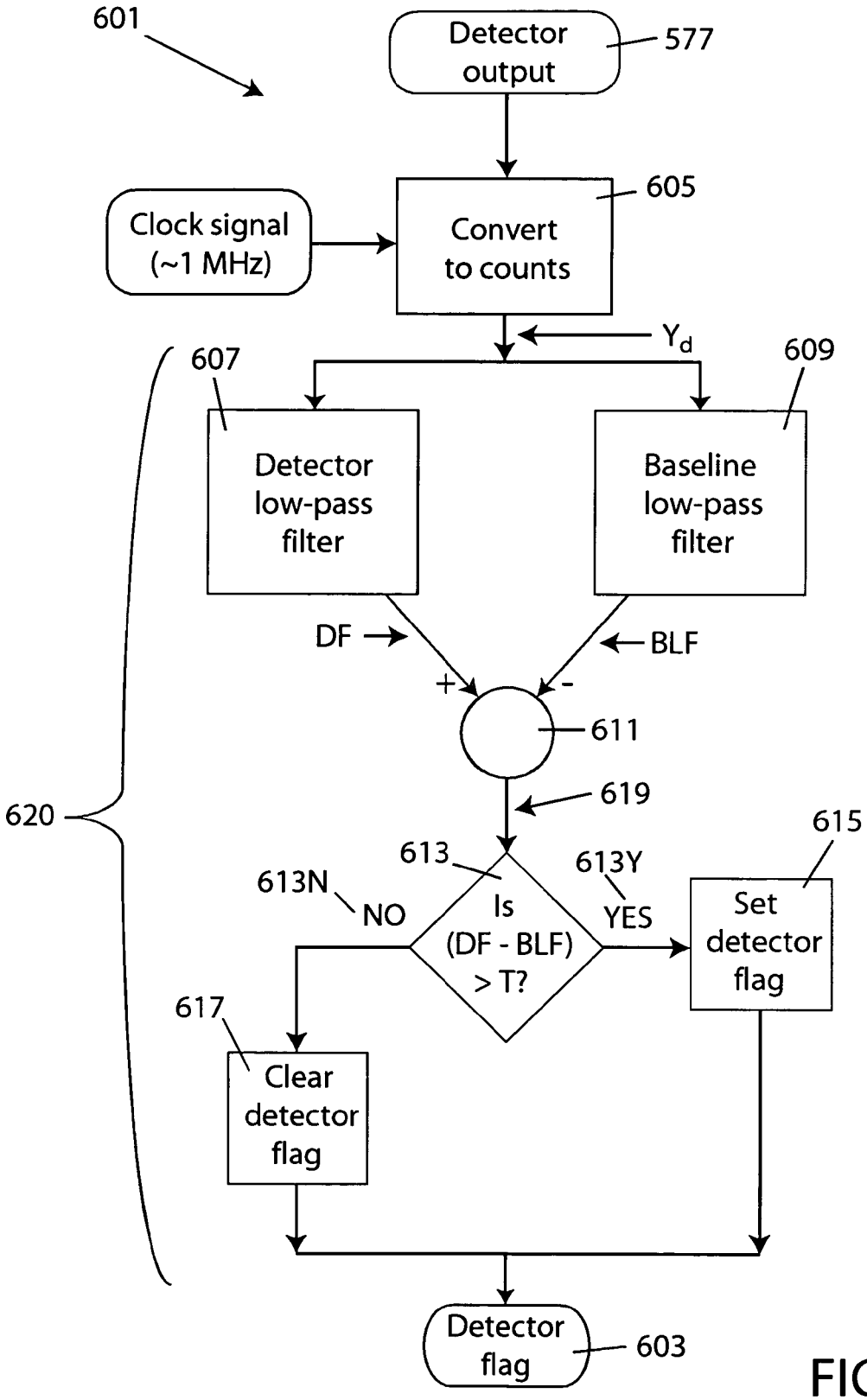
FIG. 17 is a block diagram illustrating logic of a proximity detector embodiment.
Figure 18:
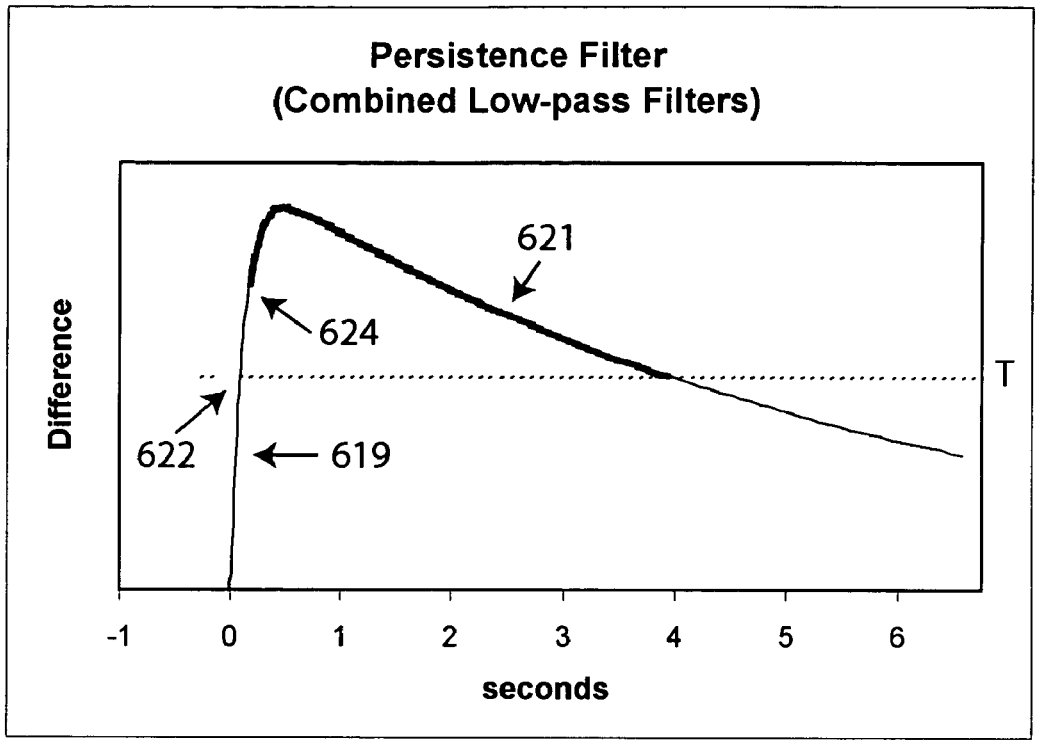
FIG. 18 is a graph illustrating operation of the logic of a hypothetical proximity detector embodiment.

The structure and operation of exemplary proximity detector apparatus 49 and control apparatus 50 will now be described in connection with FIGS. 15-19F. Control apparatus 50 is also referred to herein as a "controller." FIG. 15 is a block diagram providing an overview of proximity detector 49 and control apparatus 50 embodiments. FIGS. 16A-16E are schematic diagrams showing the electrical components of proximity detector 49 and control apparatus 50. FIG. 17 is a block diagram of the detector logic, and FIG. 18 is a performance curve; both figures are used to describe operation of proximity detector apparatus 49 and a portion of control apparatus 50 which processes the output of proximity detector 49. (In FIG. 15, proximity detector 49 is shown as "overlapping" control apparatus 50, since, in the example shown, the "processing" portion of the operation of detector 49 is carried out within control apparatus 50.) FIGS. 19A-19F provide the logic of firmware residing on a micro-controller 511 and governing operation of the exemplary dispenser control apparatus 50. A micro-controller, as is known, is a microelectronics device which produces a set of outputs responsive to a set of inputs in accordance with a set of instructions. A suitable micro-controller 511 is a MSP430F1122IPW chip manufactured by Texas Instruments Inc. of Dallas, Tex. The software flowcharts shown in FIGS. 19A-F also represent logic flow that can be implemented in discrete circuits.

Figure 16A:
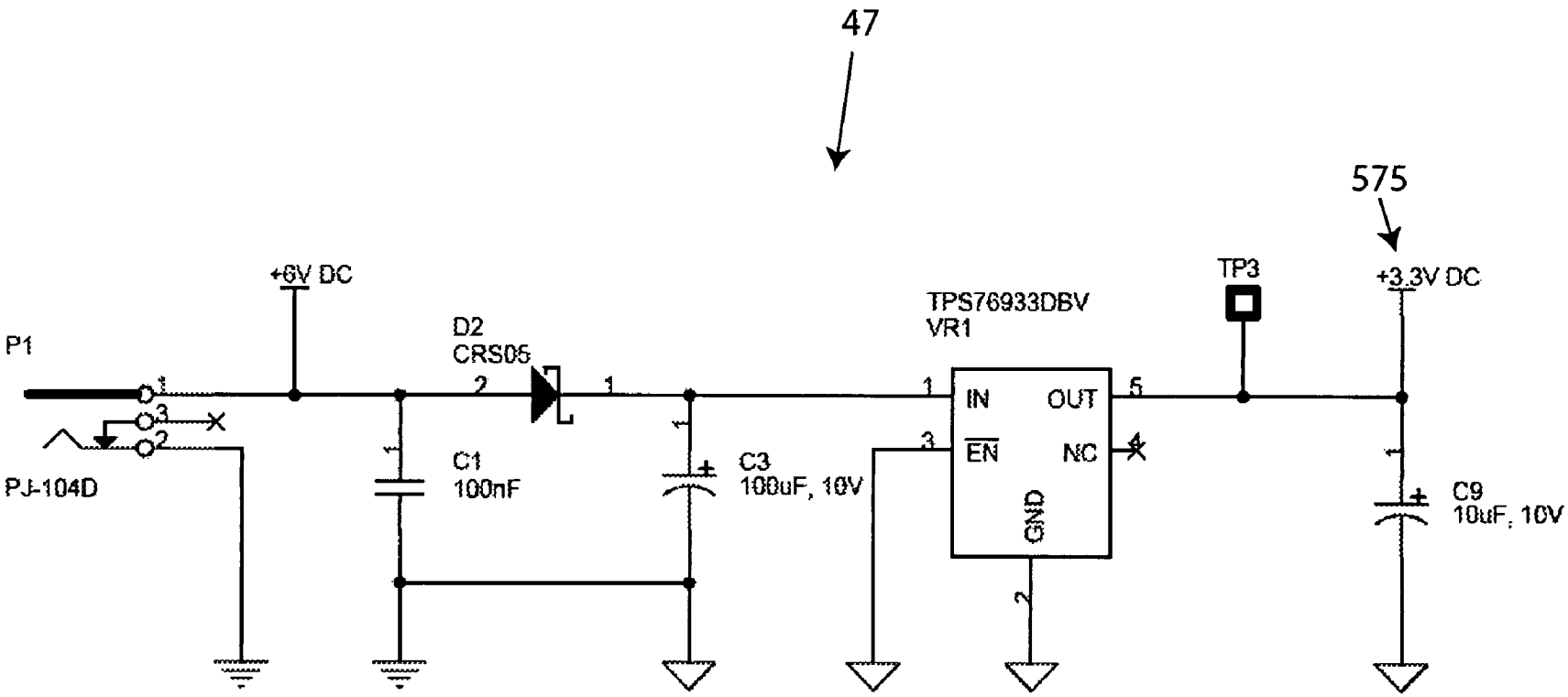
FIGS. 16A-16E are schematic diagrams showing an embodiment of preferred electrical components.
Figure 16B:
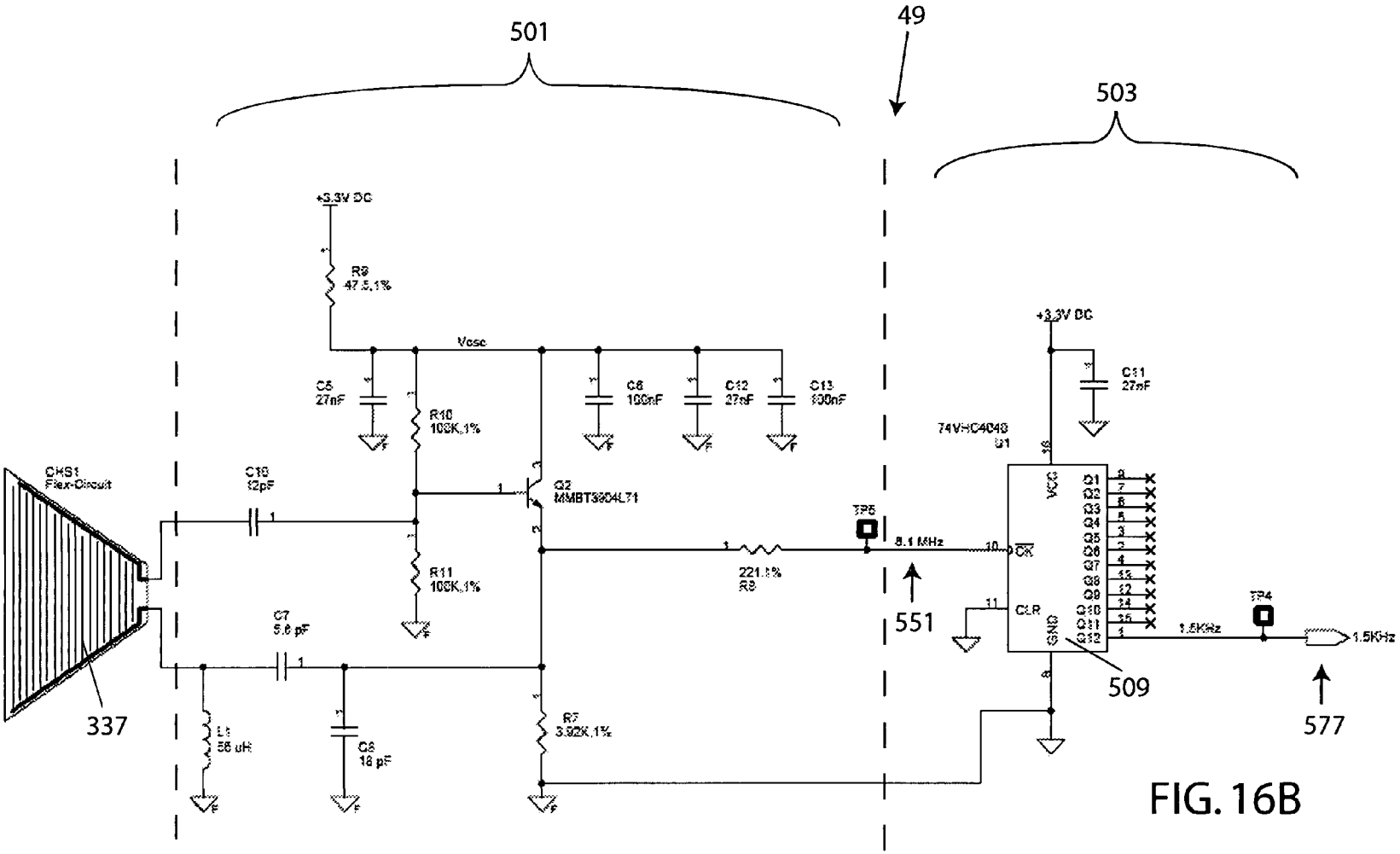
Figure 16C:
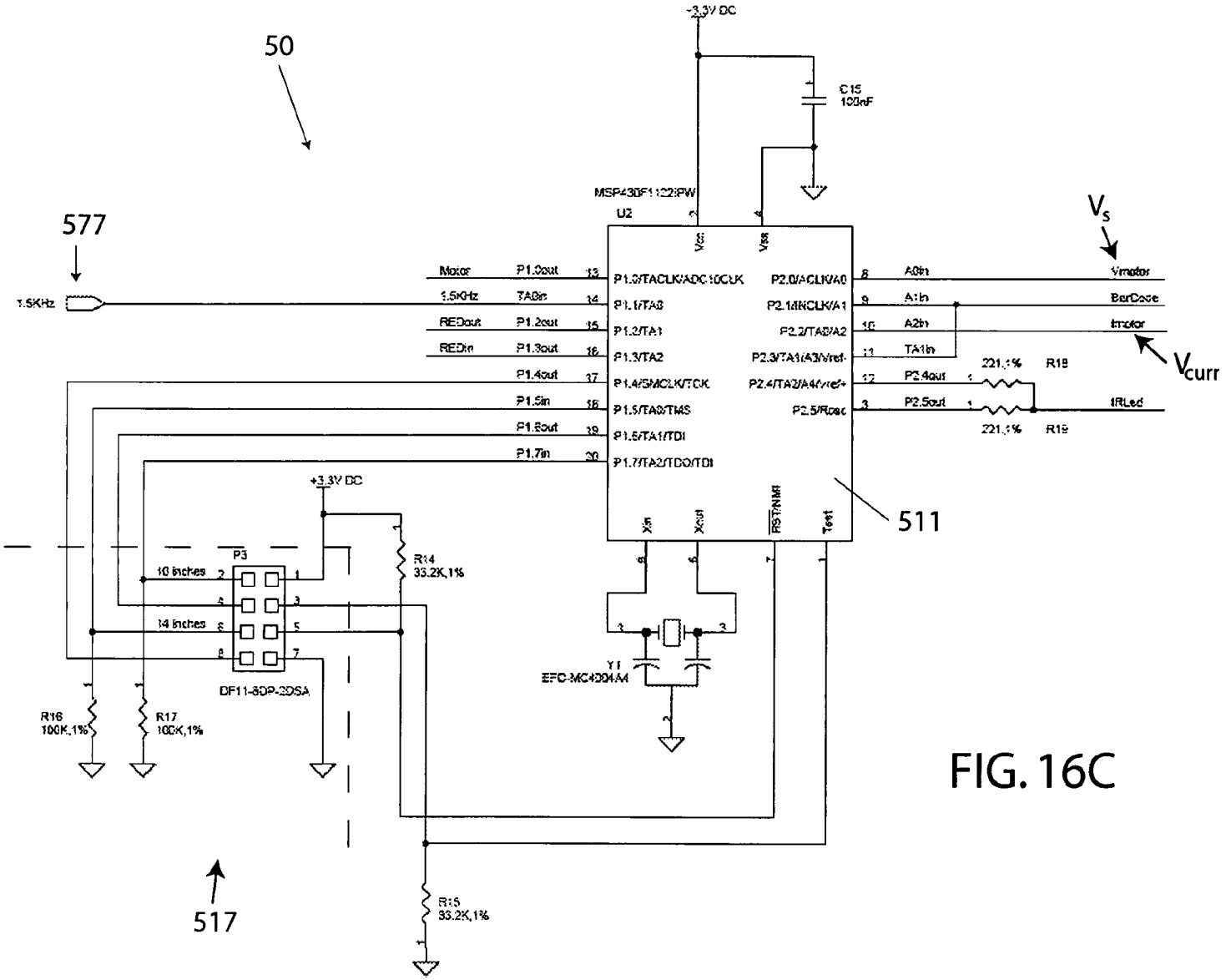
Figure 16D:
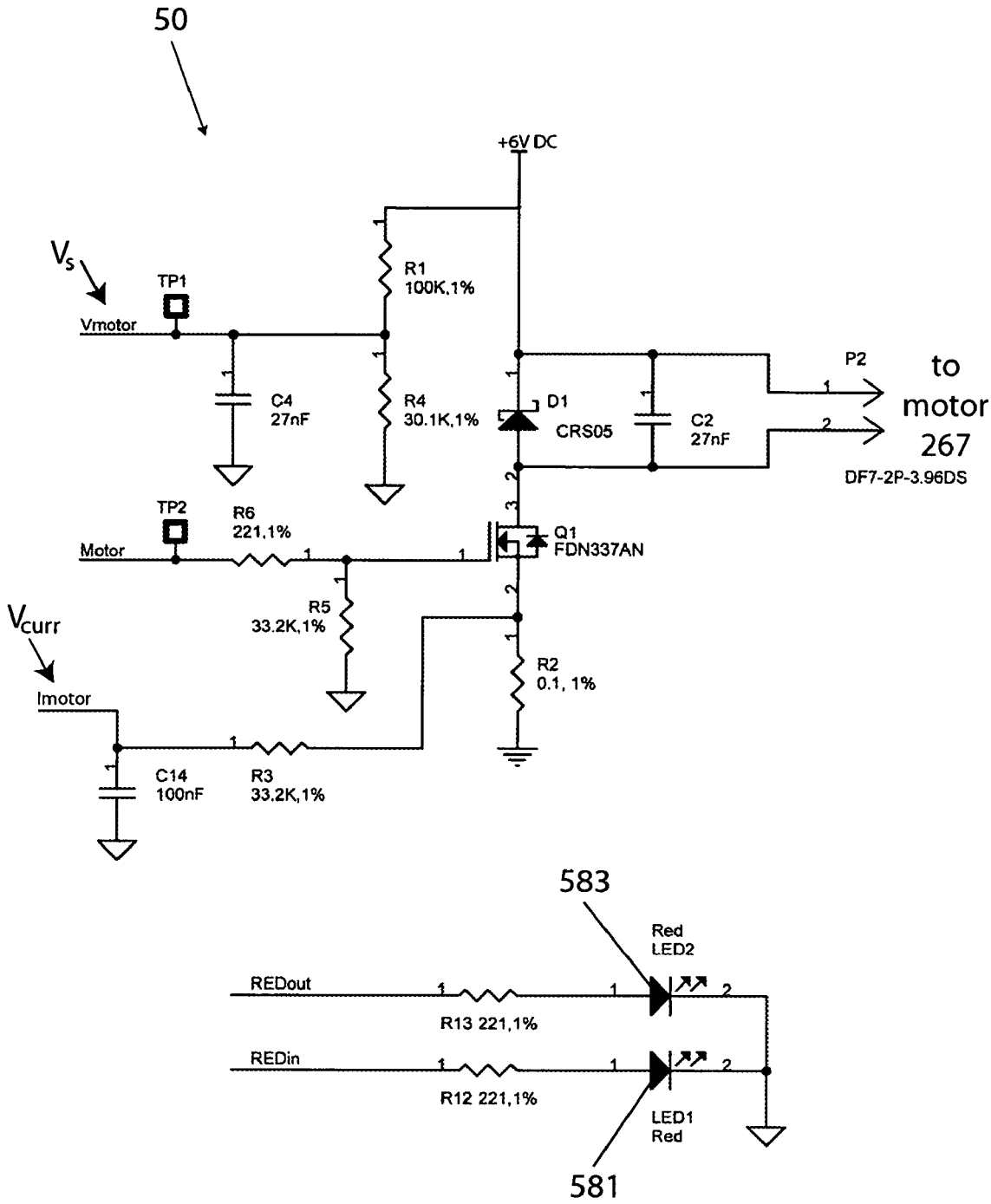

Turning first to the block diagram of FIG. 15 and the schematic circuit diagrams of FIGS. 16A-16E, the proximity detector 49 form of user input device includes sensor 337, free-running oscillator 501, and frequency divider 503 (FIG. 16B). Control apparatus 50 includes micro-controller 511 (FIG. 16C) and motor drive circuitry (FIG. 16D). Micro-controller 511 preferably includes onboard memory (not shown) and a set of instructions residing in the memory. The instructions are adapted to operate the control apparatus 50 according to FIGS. 19A-19F as described below. Micro-controller 511 and the instruction set which operates with it are used interchangeably in the discussion of micro-controller 511 operation.

Turning first to FIG. 16A, that figure is a schematic of the power supply apparatus 47 for powering the dispenser 10 and dispenser components shown in the block diagram FIG. 15. Four 1.5V "D" cell batteries (two of which are shown in FIGS. 9-11 as batteries 271, 273) are connected in series at connector P1. The batteries, the power source for dispenser 10, provides power characterized by voltage and current. As later referenced herein, the power source output values of the batteries may comprise either the voltage, current or both.

Regulated power supply apparatus 47 receives the 6V electrical power from the batteries at connector P1 and converts the voltage to 3.3V DC of regulated power output which is supplied to the remaining circuitry (except for the motor drive circuit) at the point represented by reference number 575. Regulated power supply apparatus 47 is actually connected to the points labeled 3.3V throughout FIGS. 16B-16C. The circuitry and operation of regulated power supply apparatus 47 is well-illustrated in FIG. 16A and is known to those skilled in the art of electronic circuitry. The batteries can be replaced by another source of DC power such as a transformer and AC-to-DC conversion circuitry.

Referring next to FIGS. 15 and 16B, free running oscillator 501 has a frequency which depends on the electrical capacitance of sensor 337. The capacitance of sensor 337 is changed by the presence of a user's hand in proximity to sensor 337. Oscillator 501 generates an oscillating voltage signal at point 551 of FIG. 16B. The oscillating voltage at point 551 is at a nominal frequency of approximately 6.1 MHZ when a user is not in proximity of sensor 337. This is referred to as the idle state.

Referring further to FIGS. 15 and 16B, the oscillating voltage signal output of oscillator 501 is passed through the frequency divider 503. Frequency divider 503 includes a ripple counter 509 and is configured to divide the oscillating voltage at point 551 by 4096. This generates a logical-level square wave divider output signal at point 577 of FIGS. 16B and 16C with a nominal frequency of about 1.5 kHz. Ripple counter 509 is preferably a Model 74VHC4040 12-stage binary counter available from Fairchild Semiconductor of South Portland, Me. The frequency of divider output signal at point 577 is changed by the presence of a user's hand in proximity to sensor 337, referred to as the detection state. In general, the presence of a user's hand lowers the frequency of oscillator 501 and therefore the frequency of the divider output signal at point 577.

Referring to FIGS. 15, 16C and 17, the divider output signal at point 577 is an input to micro-controller 511 pin 14. A portion of the firmware instructions which are contained within micro-controller 511 serve as detector logic 601 to generate a detector flag 603 to indicate the presence of a user's hand.

A further input to micro-controller 511 is provided by a sheet material length selecting circuit 517 which includes connector P3 used to receive jumpers (not shown). Pins 2 and 6 of P3 are normally held to a logical "low" read by the instructions in micro-controller 511 as a 12-inch towel length. Pin 4 of P3 is held "high" by pin 19 of micro-controller 511. When a jumper is used to connect either pin 2 or pin 6 to pin 4 of connector P3, micro-controller 511 interprets these jumper settings as 10-inch and 14-inch towel lengths respectively.

FIG. 16D is a schematic of the portion of control apparatus 50 circuitry connected to the outputs of micro-controller 511. These outputs include the internal and external LED's 581, 583 respectively and drive motor 267. Portions of FIG. 16C are connected to portions in FIG. 16D as indicated by common labeling. Drive motor 267 is attached to connector P2 in FIG. 16D. Resistor R2 is the current-sensing resistor used to provide a voltage signal for A/D conversion to yield a measurement of motor current-sensing voltage $V_{curr}$ proportional to the motor current. Field effect transistor (FET) Q1 is used to switch sufficient current for drive motor 267.

The logic of control apparatus 50 will be now be described with reference to the flow diagrams of FIGS. 17-19F. Such logic is in the form of the set of instructions residing in the memory of micro-controller 511. The logical steps which result in detection of a user represent detector logic 601, will first be described with reference to FIGS. 17 and 18. Thereafter, the remaining logical steps for operation of dispenser 10 will be explained in connection with FIGS. 19A-19F.

Referring then to FIG. 17, detector logic 601 operates as follows: Divider output signal 577 (FIGS. 15, 16B and 16C) delivered to micro-controller 511 from proximity detector 49. Logic module 605 of instructions residing in memory of micro-controller 511 converts output signal 577 to a stream of detector counts represented by symbol $Y_d$. Each count has a value which is equal to the number of micro-controller clock cycles (at a clock frequency $f_c$) in a fixed number $N_d$ of cycles of divider output signal 577 (with a frequency $f_d$). The stream of detector counts $Y_d$ is a sequential series of numbers each of which is determined by the following relationship:

$$Y_d = N_d f_c / f_d$$

The symbol $Y_d$ is used to represent both the stream of count values as well as each individual count in the stream. Stream of detector counts $Y_d$ is also later referred to as the output signal.

For example, if the frequency $f_d$ of divider output signal 577 is 1.5 kHz, with a clock frequency $f_c$ of 1 MHz and a value of $N_d$ of 135, the value of a detector count $Y_d$=135·1,000,000/1,500=90,000. The stream of values $Y_d$ has a new value every $N_d/f_d$ seconds.

Stream of detector counts $Y_d$ is input to two digital low-pass filters, a detector low-pass filter 607 and a baseline low-pass filter 609. Each digital low pass filter 607, 609 is in the form of firmware residing in micro-controller 511.

Each of low-pass filters 607, 609 operates as follows: During start-up, the initial low-pass filter output value is set as the initial input value of stream of detector counts $Y_d$. In the embodiment described, the symbol F generally represents the low-pass filter output value and the symbol $F_i$ represents the value of F during any cycle "i" and $F_{i+1}$ is the value of F during the following cycle. Thereafter, for each new value of $Y_d$, low-pass filter output value F is a stream of values determined as follows:

$$F_{i+1} = W \cdot Y_d + (1-W) \cdot F_i$$

where the symbol W is the weight of the filter. A typical value for W for the detector low-pass filter is $W_d$=½, and a typical value for W for the baseline low-pass filter is $W_{b1}$=1/64. Thus, the two low-pass filters operate as follows:

Detector low-pass filter 607: $DF_{i+1} = \frac{1}{2} \cdot Y_d + \frac{1}{2} \cdot DF_i$ Baseline low-pass filter 609: $BLF_{i+1} = \frac{1}{64} \cdot Y_d + \frac{63}{64} \cdot BLF_i$ The values of the outputs of the low-pass filters DF and BLF are similar to the stream of detector counts $Y_d$; that is, they are a sequential series of values, such values being in the numerical range of stream of detector counts $Y_d$.

Digital low-pass filters 607, 609 each have time constants which are equal to 1/W cycles, expressed as time constant $\tau=(1/W)\cdot N_d/f_d$ seconds. That is, the time constant $\tau_{b1f}$ of baseline low-pass filter 609 with a weight $W_{b1}=1/64$ is 64 cycles or 64·135/1,500 seconds or about 5.76 seconds. Similarly, detector low-pass filter 607 with a weight $W_d=1/2$ has a time constant $\tau_{df}$ of about 0.18 seconds.

Referring further to FIG. 17, detector flag 603 is set to indicate a valid occurrence of the presence of a user's hand. A valid occurrence is defined as a variation in the value of stream $Y_d$ which is large enough and of long enough duration to be construed as an actual request for a towel to be dispensed. Detector flag 603 is set when output DF of detector low-pass filter 607 and output BLF of baseline low-pass filter 609 differ by more than a preset threshold number of counts T; a typical value for T is 100. This differencing step is shown at the summing junction of step 611 in FIG. 17, the output of which, as indicated, is DF-BLF. The comparison with threshold T is performed on the difference DF-BLF at step 613.

This combination of detector and baseline digital low-pass filters 607 and 609 respectively serves as a "persistence filter" 620 as described in FIGS. 17 and 18. The difference DF-BLF is shown as difference output 619, also a stream of values similar to $Y_d$. The decision of step 613 is YES if DF-BLF (difference output 619) is greater than threshold T and NO if DF minus BLF is less than or equal to T. (Throughout the logical block diagrams shown herein, elements nnn of the block diagrams represent reference numbers of YES/NO decisions and are shown as having YES decisions nnnY and NO decisions nnnN.) YES decision 613Y triggers detector flag 603 to be set in step 615. NO decision 613N triggers detector flag 603 to be cleared in step 617.

This combination of detector and baseline digital low-pass filters 607 and 609 respectively (persistence filter 620) has the following behavior: (1) Persistence filter 620 ignores very brief changes in stream $Y_d$ such that changes which are too brief are not considered to be valid towel dispense requests and (2) persistence filter 620 ignores extremely slow changes in stream $Y_d$ so that filter 620 adapts to variations in the environment in which sensor 337 resides, allowing proximity detector 49 to operate properly even with large shifts in the nominal capacitance of sensor 337 due to changes in, for example, the humidity of the surrounding environment.

FIG. 18 is a representation of the approximate response of persistence filter 620 to an instantaneous change in stream $Y_d$. The curve of FIG. 18 is an example of difference output 619. The horizontal dotted line along the middle of the graph represents threshold level T. Region 621 (i.e., the bold portion of the curve) of difference output 619 represents those values of difference output 619 which are above threshold T; such values indicate points in time at which divider output signal 577 is interpreted as detecting the presence of a user's hand resulting in setting of detector flag 603. In the embodiment, there may be a slight lag between the point at which the curve crosses the threshold T and commencement of region 621. The slight lag occurs because two computation cycles of persistence filter 620 occur after the instantaneous change in stream $Y_d$ and the second cycle does not occur until the beginning of region 621. Such lag is represented in FIG. 18 by the time delay between the point 622 at which difference output 619 crosses threshold T and the beginning 624 of bold portion 621.

Soon after a user places a hand in detection zone 400 (FIGS. 1, 9-11) of sensor 337, detector flag 603 is set. If the user leaves his or her hand in detection zone 400 for a longer-than-normal length of time, detector flag 603 is cleared, thereby filtering out "persistent" requests for towels to be dispensed by the user simply holding his or her hand in detection zone 400.

The block diagrams of FIGS. 19A-19F illustrate an embodiment of a set of instructions (in addition to the portion described above as detector logic 601) for use in controlling the operation of dispenser 10. As in the case of FIG. 17, the instructions represented by the block diagram of FIGS. 19A-19F are typically provided for execution in the form of firmware embedded within a processor, such as micro-controller 511 of control apparatus 50.

Figure 19A:
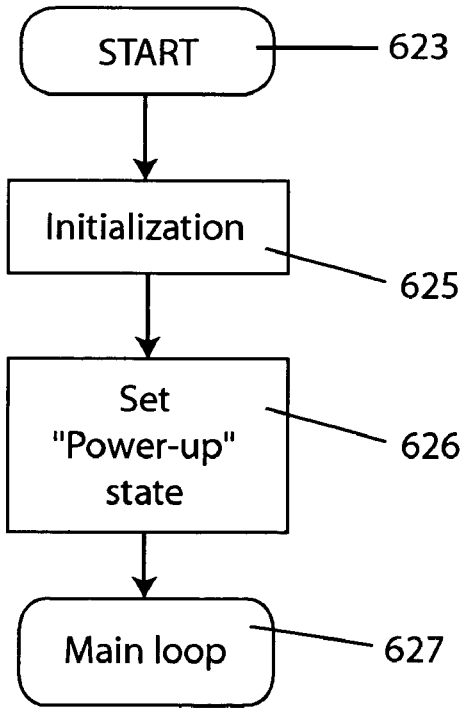
FIGS. 19A-19F are block diagrams showing preferred aspects of dispenser operation.

FIG. 19A is a block diagram illustrating an overview of the start-up portion of the instructions within micro-controller 511. When the power to control apparatus 50 is switched on at START step 623, operation proceeds with initialization step 625, which consists of a number of steps such as clearing variables and counters and setting variables and counters to initial values. The steps required for the initialization of micro-controller 511 are well-known to those skilled in the art of programming firmware. Initialization step 625 also includes a detection by micro-controller 511 of the sheet length setting, in this embodiment, shown as 10, 12, or 14 inches. Initialization step 625 is followed by a step 626 during which control apparatus is set to a "Power-up" state 637 shown in FIG. 19C. followed by the step of logically entering a main loop 627. (In FIGS. 19A-19F, the number 627 is used to indicate both the process of entering the main loop and the main loop itself)

Figure 19B:
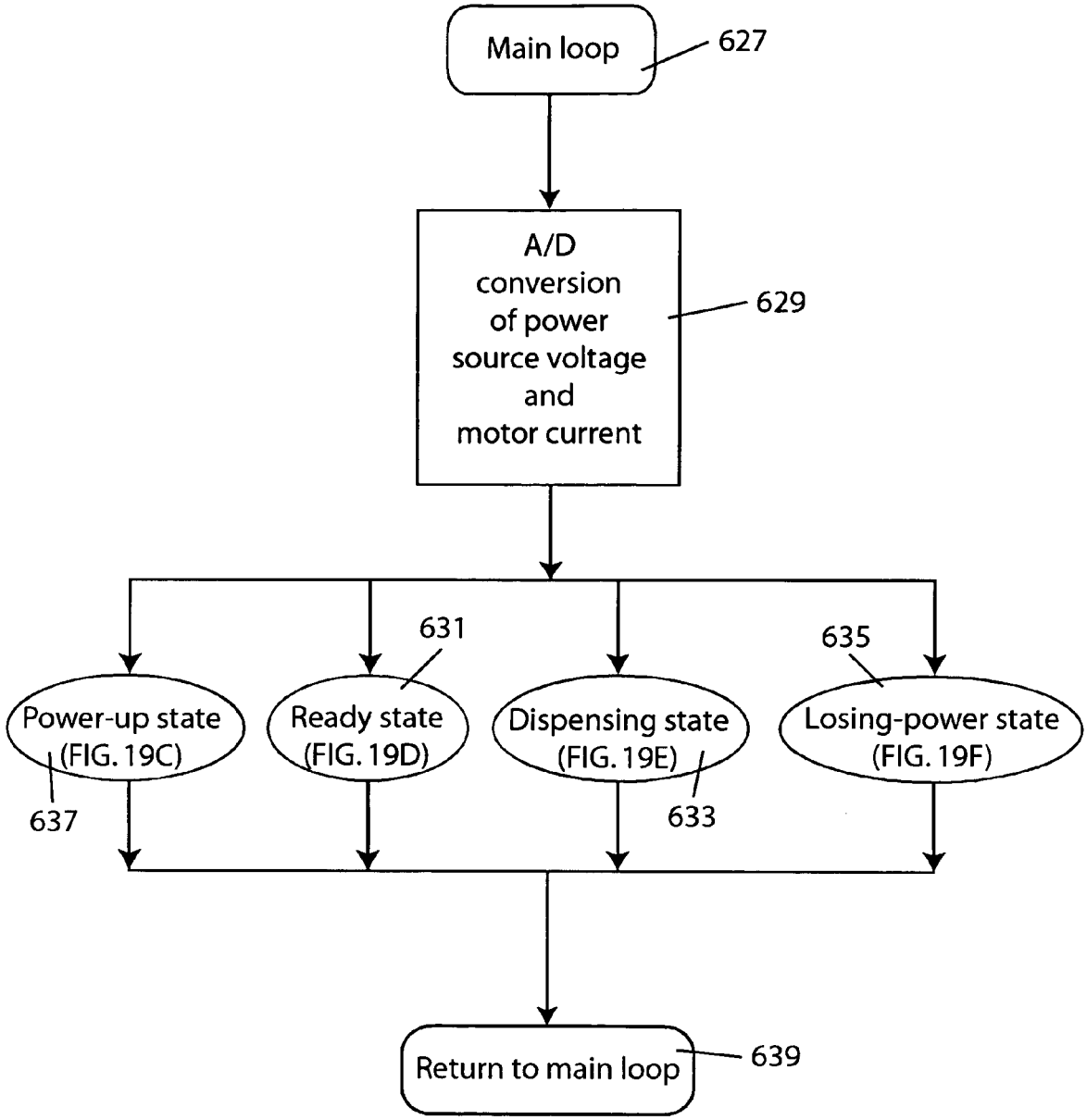

In an embodiment, the firmware logic illustrated in FIGS. 19A-19F is organized such that control apparatus 50 is in one of four states during operation, and these states are used to determine which portion of the firmware instructions are executed as the operation of micro-controller 511 proceeds through execution of main loop 627. This organization by states is illustrated in FIG. 19B.

Referring to FIG. 19B, main loop 627 is triggered to operate by an interrupt timer (not shown) which triggers main loop 627 about every 5 milliseconds. At the beginning of main loop 627, micro-controller 511 performs an analog-to-digital (A/D) conversion (step 629) of two quantities, power source voltage and motor current-sensing voltage, respectively represented by the symbols $V_s$ and $V_{curr}$ in FIGS. 16C and 16D. These quantities are then available to be used in any of the downstream instructions in the remaining portions of the control logic. At this point in main loop 627, micro-controller 511 branches to one of four different portions of the instructions, depending on what "state" the controller has been placed.

Returning briefly to FIG. 15, power source voltage detector 515 and motor current detector 516 (realized within micro-controller 511) are used during A/D conversion step 629, and sheet material length selecting circuit 517 is used during initialization step 625 to determine what towel length setting has been selected for operation of the dispenser. Based on the operation of micro-controller 511, drive motor 267 is activated and deactivated to dispense towels of the selected length.

FIGS. 19C-19F show block diagrams of the logic of the four states, "Power-up" 637, "Ready" 631, "Dispensing" 633, and "Losing-power" 635 respectively. The "Power-up" state is labeled as 637 in FIG. 19B, and the entry point of the expanded block diagram for "Power-up" state 637 is also labeled 637 in FIG. 19C to indicate the correspondence between the first of the four parallel branches of FIG. 19B and the individual expanded block diagram of FIG. 19C. The other three states are labeled in a similar fashion.

Figure 19C:
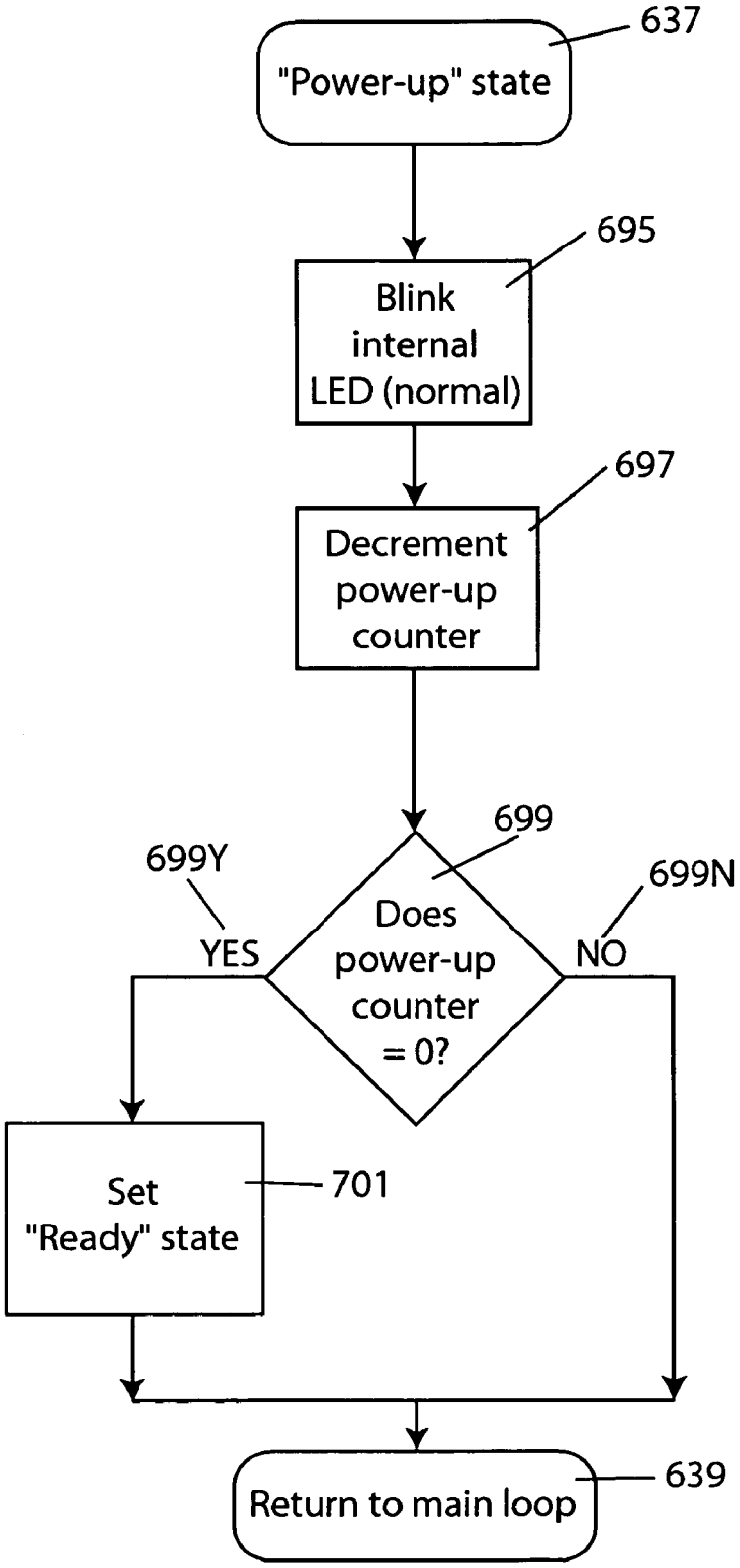

FIG. 19C is a block diagram depicting the logic of the instructions executed in main loop 627 when the controller is in "Power-up" state 637. As shown in FIG. 19A, after initialization 625 is completed, the controller state is set to "Power-up" state 637 (step 626), the purpose of which is to provide a delay for circuitry other than micro-controller 511 to establish normal operating conditions. The delay is realized through the use of a delay counter which is initialized as part of initialization 625 to a value corresponding to the number of passes through main loop 627 equivalent to the selected delay period. The period of delay may be set, for example, to one second; thus, for a main loop interrupt once every 5 milliseconds, the power-up counter would be set to 200 in step 625.

Referring again to FIG. 19C, upon entering the "Power-up" state 637 portion of main loop 627, internal LED 581 is set to blink normally (see below) in step 695, a power-up counter is decremented by one (step 697), and the power-up counter is checked in decision 699 to determine whether the counter has been fully decremented. A NO decision 699N returns the controller in step 639 to main loop 627, awaiting the next interrupt signal which again triggers main loop 627. Upon a YES decision 699Y, indicating that the power-up delay has been completed, the controller is set to "Ready" state 631 and is returned to main loop 627 by step 639. (The power-up counter is not shown since, as with generally all of the elements of the logic, it resides in firmware instructions. "Not shown" will not be indicated in all further such cases herein.)

Figure 19D:
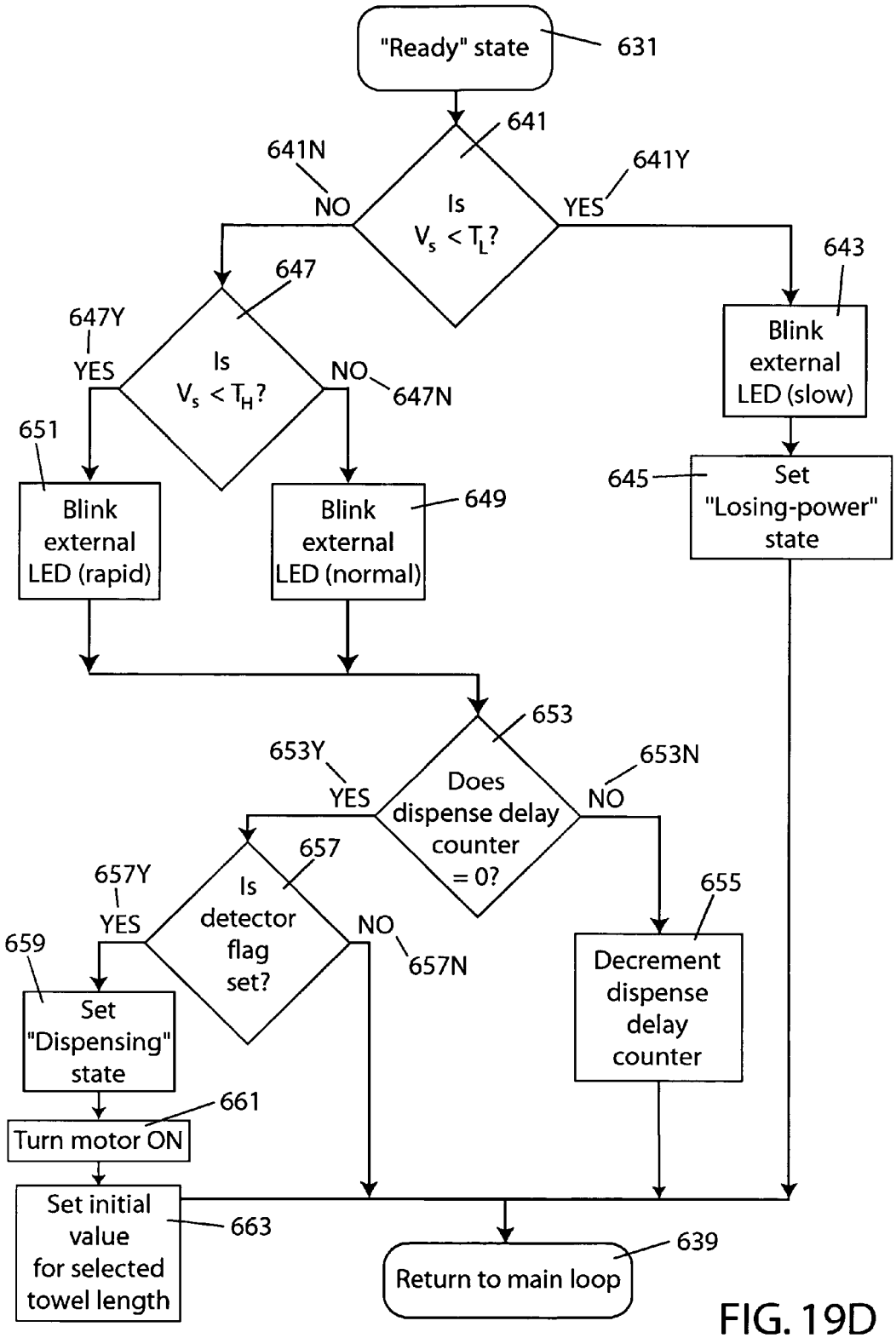

FIG. 19D is a block diagram depicting the logic of the instructions executed in main loop 627 when the controller is in "Ready" state 631. "Ready" state 631 is the state during which micro-controller 511 monitors the health of the power supply (e.g., the remaining life of batteries) and checks to see if a user has requested a towel.

A series of optional steps are provided in the embodiment described in FIG. 19D to convey information indicating the state of the electrical power source, preferably in the form of one or more batteries. In an embodiment, such battery health information is provided by adjusting the blink rate of external LED 583. In an embodiment, three rates are provided, herein indicated as "slow," "normal," and "rapid." These rates are easily distinguishable by an operator, such as "slow"=once every 5 seconds, "normal"=once every 2 seconds, and "rapid"=once every one-half second.

Figure 20:
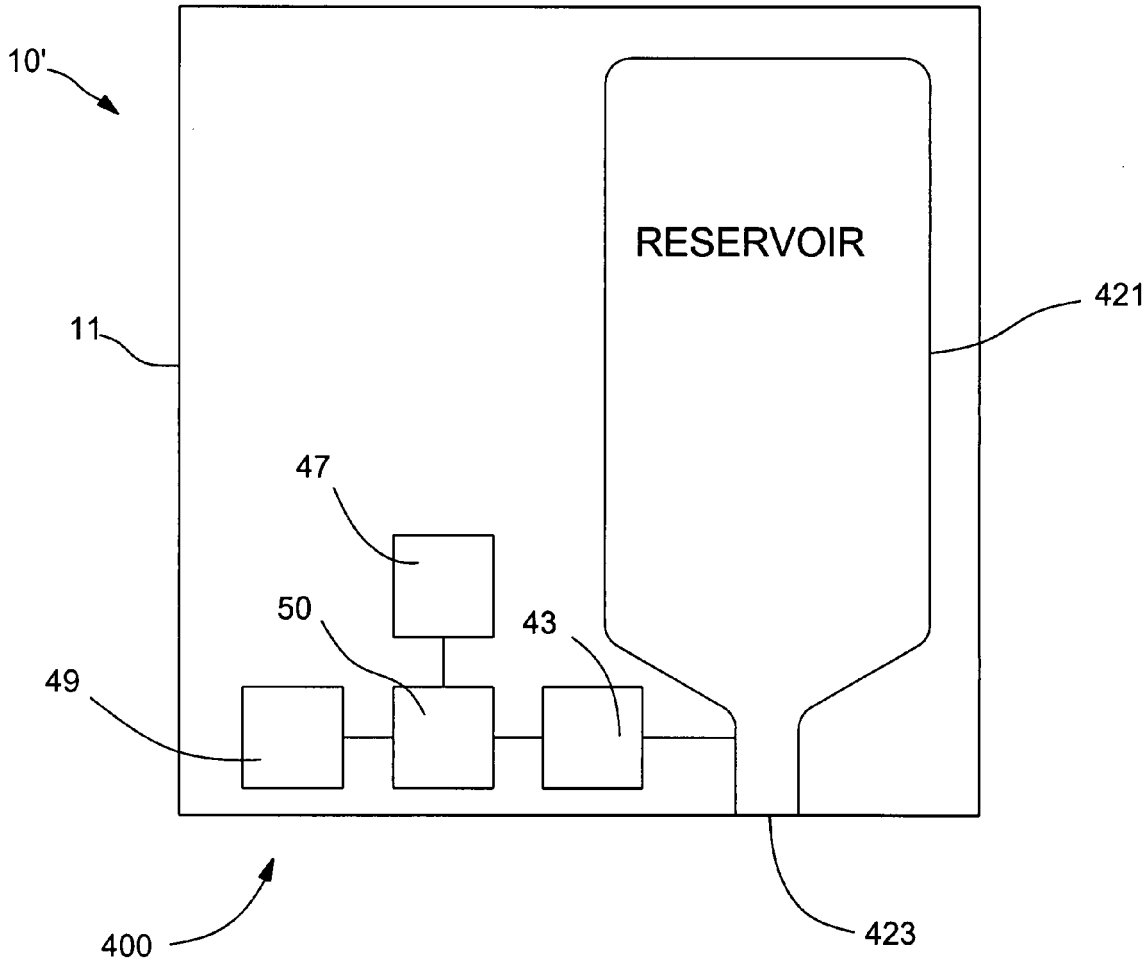
FIG. 20 is a schematic drawing of an automatic soap dispenser embodiment.

Returning to FIG. 19D, a decision 641 tests if $V_s$ is less than a low-voltage threshold $T_L$. Since micro-controller 511 is in "Ready" state 631 and thus drive motor 267 is not powered, $V_s$ is essentially a measurement of the unloaded voltage of the power supply. $T_L$ has a value such as 4.0 volts, a level of voltage indicating that the batteries are at the end of their useful life. If $V_s$ is below $T_L$ (YES decision 641Y), the external LED 583 is set to blink at the "slow" blink rate in step 643. Micro-controller 511 is set to be in "Losing-power" state 635 (FIG. 20F) in step 645, and the controller returns to main loop 627 in step 639, awaiting the next interrupt signal which again triggers main loop 627.

If the result of decision 641 is NO decision 641N, a further test of the voltage $V_s$ is carried out in decision 647 wherein $V_s$ is tested against a voltage threshold $T_H$, $T_H$ being higher than $T_L$. $T_H$ is set to a value such as 4.9 volts to indicate a level at which the batteries are near the end of their useful life. A YES decision 647Y therefore indicates that $V_s$ is between $T_L$ and $T_H$, and the micro-controller 511 then sets the external LED 583 to blink at the "rapid" blink rate (step 651) indicating that the batteries may need to be replaced in the near future. A NO decision 647N indicates that the batteries have sufficient life remaining, and the external LED blink is therefore set to the "normal" blink rate in step 649.

Figure 16E:
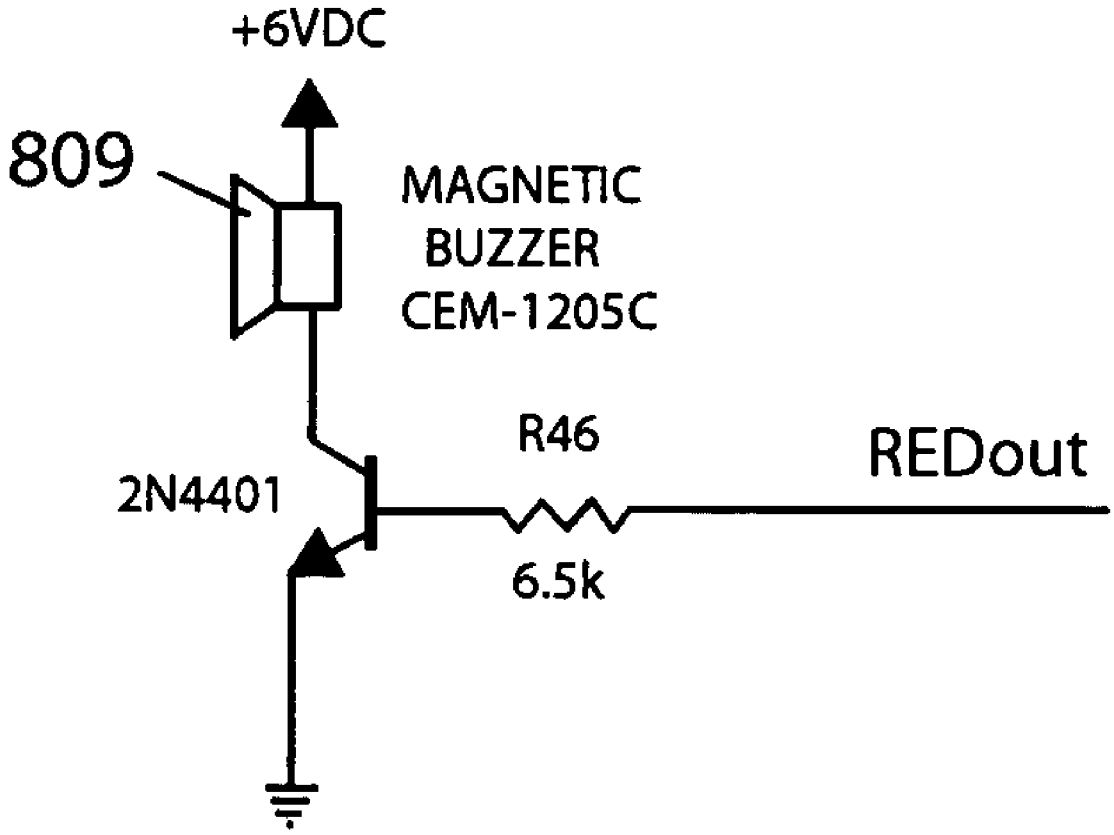

Blink patterns and rates other than those described above may be employed. For example, LED 583 may be inactive in response to a NO decision at step 647, such inactive state indicating that the batteries are at a proper operating voltage. Indicators other than LED 583 may be used to provide the optional power source condition indication. For example, and as shown in FIG. 16E, LED 583 may be replaced with an audible sound emitter such as a magnetic buzzer 585 available from CUI, Inc., Beaverton, Oreg. as part number CEM-1205C.

In an embodiment, micro-controller 511 next checks to determine whether an delay period between dispense cycles has been set and is active. Instructions residing in memory of micro-controller 511 may optionally include a delay feature imposing a delay of a predetermined time duration between dispense cycles to prevent continuous cycling of dispenser 10. If provided, such delay is initialized in step 683 of FIG. 19E at the end of a dispense cycle by the setting of a dispense delay counter in the set of instructions on micro-controller 511. The time duration of the delay period set in step 683 may be one second. The delay may be set in a fashion similar to the power-up counter. The dispense delay counter would be set to 200 in step 683 for a main loop interrupt once every 5 milliseconds.

In decision step 653, if the dispense delay counter has not reached a value of zero, the result is NO decision 653N. During each pass through the "Ready" state portion of main loop 627 during which NO decision 653N is a result, the dispense delay counter is decremented (step 655) by one until the dispense delay counter=0. If the dispense delay counter equals zero (YES decision 653Y), the controller then checks to see if detector flag 603 is set (decision 657) indicating a valid request by a user for a towel to be dispensed. A NO decision 657N is followed by step 639 which returns the controller to main loop 627, awaiting the next interrupt signal which again triggers main loop 627.

A YES decision 657Y in decision step 657 indicates that detector flag 603 is set, in which case the state of the controller is set to the "Dispensing" state 633 in step 659. The drive motor 267 is turned on at step 661, and a dispense sum is set in step 663 to a predetermined initial value which depends on the selected towel length. Micro-controller 511 is returned to main loop 627 in step 639 as described above. The dispense sum will be described in the explanation of "Dispensing" state 633 which follows.

Figure 19E:
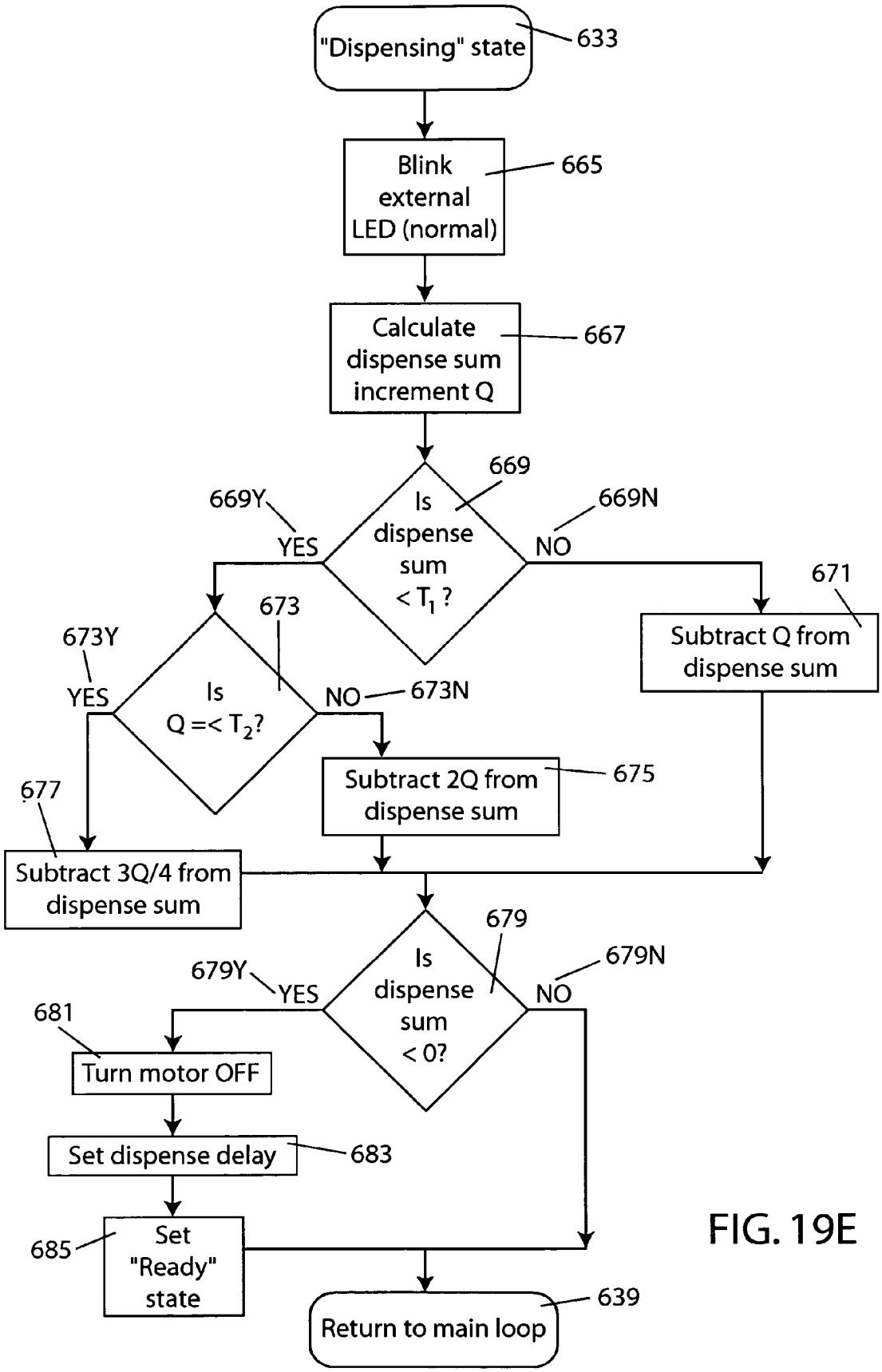

FIG. 19E is a block diagram depicting the logic of the instructions executed in main loop 627 when the controller is in "Dispensing" state 633. The general concept for control of "Dispensing" state 633 is that an estimate of the inductive component of motor 267 voltage is used to determine a further estimate of drive roller 139 rotational velocity such that motor 267 is de-powered to enable the desired length of sheet material to be dispensed. The instructions on micro-controller 511 compensate for changes in power source 49 voltage, including fluctuations during dispensing and those which occur during the life cycle of a set of batteries (e.g., batteries such as batteries 271, 273) used to power dispenser 10.

A series of further steps shown in FIG. 19E may be provided to compensate for coasting of the motor 267 which will occur after the motor 267 is de-powered. In general, the coasting steps provide mathematical operations resulting in the motor being de-powered slightly sooner if the estimate of motor RPM is above an inertia threshold $T_2$. Inertia threshold $T_2$ is an experimentally-determined value which correlates with a level of dispensing mechanism inertia useful for controlling the amount of coasting which will occur after motor de-powering. This simple determination with respect to inertia threshold $T_2$ provides a crude estimate of inertia or angular momentum. The motor 267 is de-powered sooner because the inertia in dispensing mechanism 43 and motor 267 operating at an RPM level above inertia threshold $T_2$ will result in coasting for a greater rotational distance than if the motor RPM is below inertia threshold $T_2$.

Within the circuit of 16D, power source voltage $V_s$ is the sum of several individual voltage terms, including the voltage $V_R$ across the resistive portion of the motor armature impedance, voltage $V_{ind}$ across the inductive portion of the motor armature impedance, the voltage $V_{FET}$ across the motor drive transistor Q1, and the motor current-sensing voltage $V_{curr}$ across the current-sensing resistor R2. This sum is expressed as follows:

$$V_s=V_R+V_{ind}+V_{FET}+V_{curr}$$

or can be expressed by solving for $V_{ind}$:

$$V_{ind}=V_s-V_R-V_{FET}-V_{curr}$$

Since $V_{ind}$ is approximately proportional to the RPM of the motor, an estimate of $V_{ind}$ provides an estimate of motor RPM. The following approximation facilitates this estimation:

$$V_R+V_{FET}+V_{curr}\cong 3\cdot V_{curr}$$

resulting in the following relationship:

$$V_{ind}\cong V_s-3\cdot V_{curr}$$

The estimate of $V_{ind}$ is defined as a dispense sum increment Q. As such, dispense sum increment Q is an instantaneous estimate of $V_{ind}$, based on measurements of $V_s$ and $V_{curr}$. Both $V_s$ and $V_{curr}$ are analog inputs to two analog-to-digital (A/D) lines at pins 8 and 10 respectively of micro-controller 511. Thus, Q is approximately proportional to motor 267 RPM, and a sum of a sequence of values for Q is approximately proportional to the length of sheet material dispensed. In the calculation of Q, indicated in step 667 in FIG. 19E, Q is constrained to be non-negative.

Referring further to FIG. 19E, upon entering "Dispensing" state 633, the external LED 583 is first set to blink at the normal rate. Next, in step 667, the instructions begin the estimating process by determining dispense sum increment Q as described above. In step 629, both $V_s$ and $V_{curr}$ are measured by micro-controller 511 during each pass through main loop 627.

In the embodiment described herein, the summing of dispense sum increments Q is accomplished by decrementing the predetermined initial value until the dispense sum drops below zero, at which point the dispense cycle is ended, thereby consistently controlling the sheet length as desired. For example, a representative target value for a 12-inch length of sheet material in the form of paper towel could be 120,000. A first dispense sum increment Q may be on the order of 100. Subtracting a value Q of 100 from target value 120,000 results in a dispense sum of 119,900. As the dispensing mechanism 43 accelerates and continues to operate, further sequential subtracting of each newly-determined dispense sum increment Q from the dispense sum results in attaining a zero value, typically in about 0.6 seconds, at which time micro-controller 511 de-powers motor 267. The values of Q resulting from measurements of $V_s$ and $V_{curr}$ fluctuate widely as the motor 267 RPM changes during a dispense cycle and as the power source voltage changes.

The instructions compensate for fluctuations in power source voltage $V_s$ to provide consistency in the lengths of sheet material dispensed from dispenser 10. For example, battery voltage $V_s$ will decrease over the life cycle of the batteries. As battery voltage $V_s$ decreases, motor 267 is driven at lower RPM and thus the value of each dispense sum increment Q is decreased. As the value of dispense sum increments Q decrease, the number of operations required to reach the target value increases, and a relatively greater time duration is required to complete the calculation to reach the target value, thereby compensating for the voltage decrease by powering the motor 267 for an increased time duration.

The remaining steps of dispensing state 633, including an optional coasting compensation feature, are now described with respect to the remainder of FIG. 19E. After the calculation of dispense sum increment Q in step 667, the dispense sum is tested in decision step 669 to see if it has been decreased below dispense sum threshold $T_1$. If the result is NO decision 669N, the dispense sum is decremented by dispense sum increment Q. If the result is YES decision 669Y, then dispense sum increment Q is tested in decision step 673 to see if it is equal to or below inertia threshold $T_2$. If the result of this test of Q (step 673) is NO decision 673N, the dispense sum is decremented by two times the dispense sum increment Q in step 675. If the result of this test of Q (step 673) is YES decision 673Y, the dispense sum is decremented by 0.75 times the dispense sum increment Q in step 677. The higher multiplying factor (e.g., 2 versus 0.75) means that motor 267 will be de-powered sooner since more coasting will occur after motor 267 is de-powered.

As further explanation, for most of the period of time in which drive motor 267 is powered (dispensing towel), the dispense sum is reduced by dispense sum increment Q. When the dispense cycle approaches its completion as indicated by dispense sum threshold $T_1$, dispense sum increment Q is tested against inertia threshold $T_2$ as a quick estimate of the amount of coasting which will occur when drive motor 267 is turned off in step 681. Higher values of Q (above inertia threshold $T_2$) trigger a faster decrementing of the dispense sum to turn off the motor a bit sooner than values of Q below inertia threshold $T_2$.

Following the decrementing of the dispense sum in steps 671, 675, or 677, the dispense sum is tested to see if it has been lowered below zero (step 679). If the result of decision step 679 is NO decision 679N, the controller 511 proceeds to step 639 which returns the controller to main loop 627, awaiting the next interrupt signal which again triggers main loop 627 with the dispensing cycle still underway (micro-controller 511 in "Dispensing" state 633). If the result of decision step 679 is YES decision 679Y, drive motor 267 is turned off in step 681, the dispense delay counter is set to its initial value in step 683, the controller is set to "Ready" state 631, and step 639 returns the controller to main loop 627, awaiting the next interrupt signal which again triggers main loop 627.

In step 669, the dispense sum is calculated by sequentially decrementing the dispense sum increments Q from the current value of the dispense sum. Mathematically, the term "dispense sum" refers to the total accumulation of dispense sum increments Q. The verbs "sum" or "summed" as used herein are defined as the process of mathematically accumulating the increments. The accumulation may consist of either sequential additions or subtractions (as is the case in the embodiment described above). For example, the dispense sum can also be determined by sequentially adding up the individual values of Q to reach a predetermined target value. Naturally, persons of skill in the art will appreciate that the important feature is the size of the accumulated dispense sum and not the specific numerical values associated with the initial and target values Irrespective of the form of the operation performed, the target value corresponding to each sheet length is a constant selected such that the accumulation of estimated dispense sum increments Q results in sheets of the proper length being dispensed.

The coasting compensation feature described above is preferred but not required. If the optional coasting control is not used, decision step 669 is eliminated and every cycle through the dispensing state logic flows through step 671 such that dispense sum increment Q is subtracted from the dispense sum in each cycle through the logic. The dispenser 10 then proceeds through steps 679 through 685 as described above until the motor 267 is de-powered by the dispense sum reaching a target value in step 679. (In this example, the target value for the dispense sum is zero, with the dispense sum being decremented from an initial value representing requested towel length.)

Figure 19F:
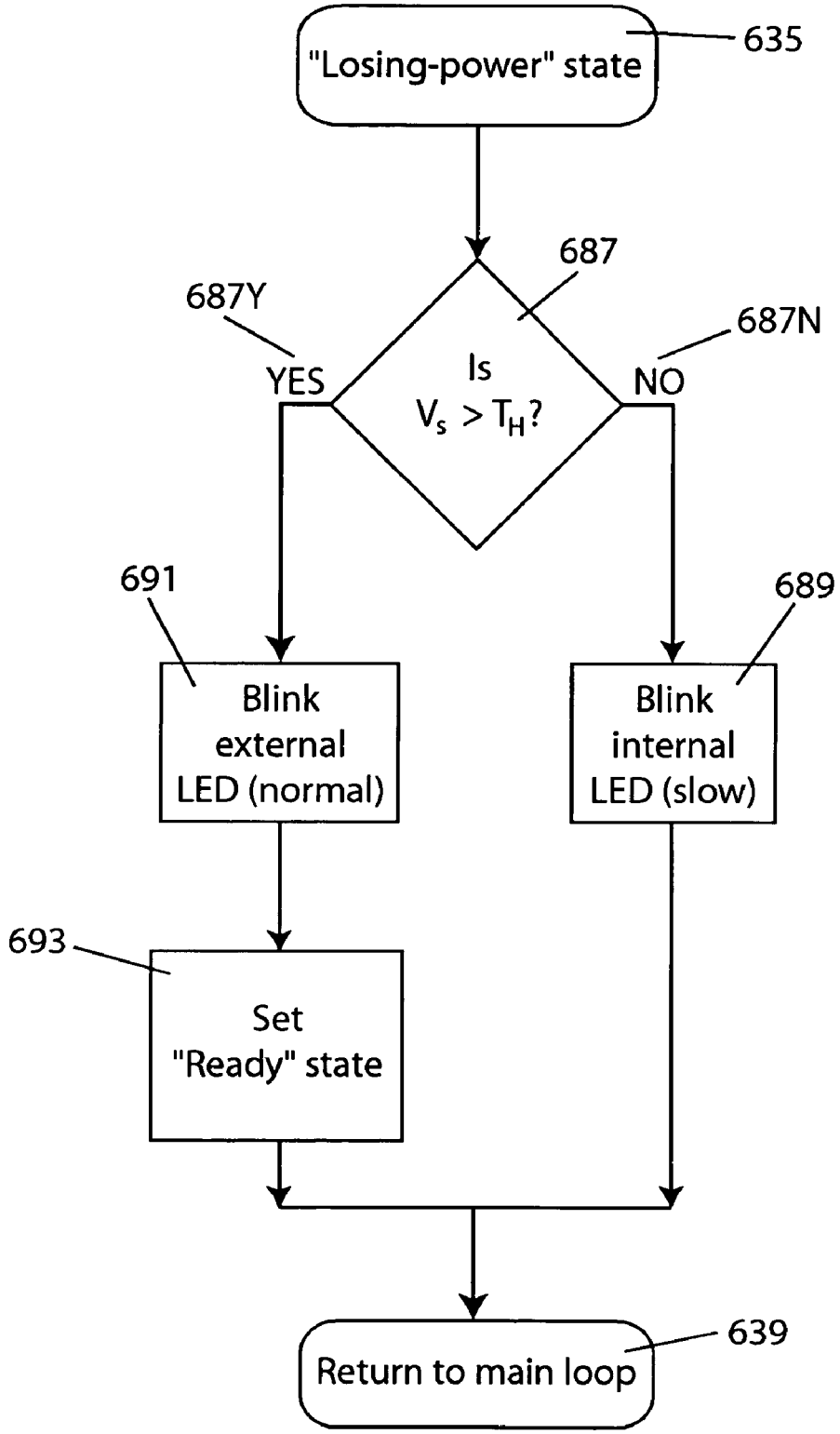

FIG. 19F is a block diagram depicting the logic of the instructions executed in main loop 627 when the controller is in "Losing-power" state 635. Since batteries are able to recover to some degree from low values of voltage $V_s$, the unloaded (motor de-powered) voltage of the batteries is tested (step 687) during each pass through main loop 627 while micro-controller 511 is in "Losing-power" state 635 to see if $V_s$ has risen above $T_H$, indicating that there is still useful life in the batteries. A NO decision 687N sets internal LED 581 to blink slowly and returns via step 639 to main loop 627. A YES decision 687Y results in external LED 583 to be set to normal blinking (step 691) and micro-controller 511 to be set to "Ready" state 631 prior to being returned in step 639 to await the next interrupt to trigger main loop 627.

Operation of exemplary automatic dispenser 10 and an exemplary method of dispensing will now be described. The method of dispensing will be adapted to the specific type of automatic dispenser apparatus utilized with the proximity detector.

The first step of the dispensing method involves loading the dispenser with product to be dispensed. For the sheet material dispenser 10, such loading is accomplished with respect to dispenser 10 in the following manner. The dispenser cover 17 is initially opened causing roller frame assembly 173 to rotate outwardly about axially aligned pivot openings positioned in frame sidewall 53, 59, one of which is identified by reference number 189 (FIG. 8). The rotational movement of frame assembly 173 positions tension roller 141 and transfer assembly 227 away from drive roller 139 providing unobstructed access to housing interior 15 and space 75.

When dispenser 10 is first placed in operation, a roll 41 of sheet material, such as paper toweling or tissue, may be placed on yoke 125 by spreading arms 131, 133 apart to locate the central portions of holders 135, 137 into roll core 117. The sheet material 111 is positioned over drive roller 139 in contact with drive roller segments 143-147. A roll could be stored on cradle 119 awaiting use. Further, cradle 119 could be removed to insert fresh batteries into battery box 311. Thereafter, cover 17 is closed as shown in FIG. 1. Movement of cover 17 to the closed position of FIG. 1 causes the leaf springs 213, 215 mounted on the roller frame assembly 173 to come in contact with the inside of cover 17 resiliently to urge the tension roller 141 into contact with sheet material 111 from roll 39 thereby ensuring frictional contact between the sheet material 111 and the drive roller 139 and, more particularly, drive roller segments 143-147. The dispenser 10 is now loaded and ready for operation.

Subsequent steps involve the electrical components of the proximity detector and control apparatus 49, 50.

At power up, the dispenser micro-controller 511 initializes (step 625) and loops through the "Power Up" and "Ready" states 637, 631 and to the main loop 627 awaiting setting of a detector flag 603 upon recognition of a user by proximity detector 49. When a person approaches dispenser 10, the instructions proceed through the detection logic in the series of steps 601 resulting in setting of the detection flag in step 603. In "Ready" state 631, the motor 267 is turned on in step 661. Rotation of drive roller 139 by motor 267 draws sheet material 111 through the nip 157 and out of the dispenser 10 through discharge opening 67.

In the "Dispensing" state 633, when the dispense sum reaches or drops below 0, the motor 267 is de-powered and any optional coasting of drive roller 139 results in dispensing of the desired length of sheet material to the user. Dispenser 10 returns to the main loop 639 and will not dispense again until the dispense delay counter=0 in step 653. The user may then separate sheet 111 into a discrete sheet by lifting sheet 111 up and into contact with tear bar 71 serrated edge 207, tearing the sheet 111.

After repeated automatic dispensing cycles, cover 17 is removed to permit replenishment of the sheet material. At this time, a portion of stub roll 39 may remain and a reserve roll 41 of sheet material can be moved into position. As illustrated in FIG. 9, partially dispensed stub roll 39 (preferably having a diameter of about 2.75 inches or less) is now moved onto cradle 119 arcuate surfaces 121, 123. Sheet material 111 extending from stub roll 39 continues to pass over drive roller 139.

After stub roll 39 is moved to the position in frame 13 shown in FIG. 9, a fresh reserve roll 41 can be loaded onto yoke 125. Sheet material 113 is then threaded onto the transfer assembly 227. More specifically, sheet material 113 is urged onto catch 256 which pierces through the sheet material 113. Sheet material 113 is further led under pins 259, 261 to hold sheet material 113 in place on the transfer assembly 227 as shown in FIG. 9. Transfer assembly surface 250 rests against sheet material 111. Surface 250 will ride along sheet material 111 without tearing or damaging material 111 as it is dispensed. The cover 17 is then closed to the position shown in FIG. 1.

After further automatic dispensing cycles, sheet material 111 from stub roll 39 will be depleted. Upon passage of a final portion of sheet material 111 through nip 157, transfer surface 250 will come into direct contact with arcuate surface 257 of drive roller 139. Frictional engagement of drive roller segment 145 and surface 250 causes transfer assembly 227 to pivot rearwardly and slide up along slots 237, 239. Movement of transfer assembly 227 as described brings teeth 253 along arcuate surface 251 into engagement with drive roller segment 145. Engagement of teeth 253 with the frictional surface of segment 145 forcefully urges sheet material 113 held on catch 256 into contact with drive roller surface 257 causing sheet material 113 to be urged into nip 157 resulting in transfer to roll 41 as shown in FIG. 10. Following the transfer event, transfer assembly 227 falls back to the position shown in FIG. 10. Thereafter, sheet material 113 from roll 41 is dispensed until depleted or until such time as the sheet material rolls are replenished as described above.

The invention is directed to automatic dispenser apparatus generally and is not limited to the specific automatic dispenser embodiment described above. For example, there is no requirement for the dispenser to dispense from plural rolls of sheet material, and there is no requirement for any transfer mechanism as described herein. The sheet material need not be in the form of a web wound into a roll as described above. The novel proximity detector 49 and control apparatus 50 will operate to control the dispensing mechanism 43 of virtually any type of automatic sheet material dispenser, including dispensers for paper towel, wipes and tissue.

The novel proximity detector 49 will also operate with automatic dispensers other than sheet material dispensers. For example, the proximity detector will operate to control automatic personal care product dispensers, such as liquid soap dispensers. An automatic soap dispenser embodiment 10' is shown schematically in FIG. 20. In soap dispenser embodiment 10', the power supply apparatus 47, proximity detector 49 and control apparatus 50 components may be housed in an automatic soap dispenser apparatus housing 11. Dispensing mechanism 43 may be a solenoid or other mechanical actuator. An appropriate fluid reservoir 421 in communication with the solenoid or actuator (i.e., dispensing mechanism 43) is provided to hold the liquid soap. The solenoid or other actuator discharges soap from the dispenser through a fluid-discharge port. The detection zone 400 is generated below the soap dispenser adjacent the fluid-discharge port 423.

Operation of the soap dispenser 10' may include steps/states 601 (including steps 577-603), 623, 625, 626, 627 together with "Power up" state 637, "Ready" state 631, "Dispensing" state 633, and "Losing power" state 635 and the corresponding apparatus described with respect to the dispenser 10. (Steps 667 through 679 would not be relevant for the soap dispenser.) In the soap dispenser embodiment 10', turning the motor on in step 661 is available to power the solenoid or other actuator in a manner identical to the manner in which the drive signal is generated in the dispenser embodiment 10. Powering of the solenoid or other actuator to dispense a unit volume of soap from the soap dispenser port 423 into the user's hand. The programmed instructions in micro-controller 511 will be tailored to the specific type of soap dispenser being used, for example to limit the number of dispensing cycles per detection event and to limit the dwell time between dispensing cycles.

The dispenser apparatus may be made of any suitable material or combination of materials as stated above. Selection of the materials will be made based on many factors including, for example, specific purchaser requirements, price, aesthetics, the intended use of the dispenser, and the environment in which the dispenser will be used.

While the principles of this invention have been described in connection with specific embodiments, it should be understood clearly that these descriptions are made only by way of example and are not intended to limit the scope of the invention.

The invention claimed is:

1. An automatic sheet material dispenser comprising:

a housing adapted to receive at least one sheet material roll;

an electrical power source;

a user input device which generates a user-responsive signal;

a dispensing mechanism powered by a motor; and motor control apparatus adapted to:

power the motor responsive to the signal;

repetitively obtain electrical power source output values during powering of the motor;

perform mathematical operations using the values to produce a computed value; and de-power the motor when the computed value reaches a target value corresponding to a length of dispensed sheet material.

2. The dispenser of claim 1 wherein the motor control apparatus includes a micro-controller having a memory and a set of instructions adapted to repetitively obtain the values and perform the mathematical operations.

3. The dispenser of claim 2 wherein the values include a power source voltage $V_s$ and a motor current-sensing voltage $V_{curr}$.

4. The dispenser of claim 3 wherein the mathematical operations include repetitively determining dispense sum increments according to the formula, the power source voltage $V_s$ minus three times motor current-sensing voltage $V_{curr}$, and the instructions are adapted to repetitively determine the dispense sum increments.

5. The dispenser of claim 4 wherein the instructions are adapted to sequentially sum the dispense sum increments and to de-power the motor when the sum reaches the target value.

6. The dispenser of claim 5 wherein the motor control apparatus further includes a sheet material length selecting circuit and the selecting circuit is used to select from among a plurality of predetermined target values, each target value corresponding to a predetermined sheet material length.

7. The dispenser of claim 6 wherein the dispensing mechanism comprises:

a drive roller powered by the motor;

a tension roller positioned against the drive roller to form a nip therebetween, said sheet material being drawn through the nip and out of the dispenser by powering of the drive roller; and wherein the instructions are adapted to compensate for coasting of the dispensing mechanism occurring after motor de-powering, said instructions multiplying a portion of the dispense sum increments by a factor determined by comparing dispense sum increments to an inertia threshold.

8. The dispenser of claim 7 wherein:

the factor is applied when the sum of the dispense sum increments reaches a dispense sum threshold; and the factor is varied such that if the dispense sum increment is above the inertia threshold, the motor is de-powered earlier in the dispense cycle and if the dispense sum increment is below the inertia threshold, the motor is de-powered later in the dispense cycle, whereby dispensing mechanism coasting is estimated in a determination of when to de-power the motor.

9. The dispenser of claim 2 wherein the electrical power source is selected from the group consisting of at least one battery and an AC to DC power supply.

10. An automatic product dispenser comprising:

a housing adapted to receive a dispensable product;

an electrical power source;

an electrically-powered dispensing mechanism; and a proximity detector for detecting a user without physical contact by the user, said detector having:

a signal responsive to the presence of a user; and a micro-controller having a memory with a set of instructions, said instructions including:

a first digital low-pass filter having a time constant, said first filter receiving the signal and providing a first output; and a second digital low-pass filter having a time constant different than the first filter time constant, said second filter receiving the signal and providing a second output, the micro-controller instructions being adapted to determine a difference between the first and second outputs and to operate the dispensing mechanism to dispense the dispensable product responsive to the difference.

11. The dispenser of claim 10 wherein the dispensable product is selected from one or more of the group consisting of towel, tissue, wipes, sheet-form materials, soap, shaving cream, fragrances and personal care products.

12. The dispenser of claim 10 wherein the dispenser is a sheet material dispenser and the dispensing mechanism comprises:

a drive roller;

a motor in power-transmission relationship with the drive roller; and a tension roller positioned against the drive roller to form a nip therebetween, said sheet material being drawn through the nip and out of the dispenser by powering of the drive roller; and the micro-controller controls the dispensing mechanism to dispense the sheet material responsive to detection of the user.

13. The dispenser of claim 12 wherein the proximity detector further comprises:

a sensor element having a capacitance;

an oscillator operatively connected to the sensor and having an oscillating voltage output the frequency of which changes based on changes in the capacitance; and a frequency divider operatively connected to the oscillator and constructed to convert the oscillating voltage output into a logical-level square wave.

14. The dispenser of claim 13 wherein the oscillator further includes:

an idle-state oscillating voltage output having a frequency range; and a detection-state oscillating voltage output having a frequency range less than the idle-state oscillating voltage output frequency range.

15. The dispenser of claim 13 wherein the frequency divider is adapted to divide the frequency of the oscillating voltage output by a predetermined value as the frequency divider generates the logical-level square wave.

16. The dispenser of claim 15 wherein the logical-level square wave has a nominal frequency of about 1.5 kHz.

17. The dispenser of claim 15 wherein the micro-controller has a clock signal having a clock frequency and wherein the signal responsive to the presence of a user is a stream of numerical values, each numerical value being equal to the number of clock frequency cycles in a fixed number of logical-level square wave cycles.

18. The dispenser of claim 17 wherein:

the filters receive the stream of numerical values;

the first and second outputs are numerical value streams;

the instructions are adapted to determine the difference between the numerical value streams; and the micro-controller powers the motor when the difference between the numerical value streams reaches or exceeds a threshold.

19. The dispenser of claim 18 wherein the instructions are further adapted to de-power the motor when a desired length of sheet material has been dispensed.

20. An automatic sheet material dispenser comprising:

a housing defining a space enclosing a sheet material roll;

an electrical power source adapted to power the dispenser;

a dispensing mechanism for dispensing a length of sheet material from the dispenser, said dispensing mechanism including a drive roller and a motor in power-transmission relationship with the drive roller;

a proximity detector for detecting a user without physical contact by the user, said detector having a output signal representing detection of the user; and a controller having a memory and a program of instructions, said instructions including:

a first low-pass filter having a time constant, said first filter receiving the output signal and providing a first output;

a second low-pass filter having a time constant different from the first filter time constant, said second filter receiving the output signal and providing a second output; and the instructions determine a difference between the first and second outputs, such that the controller powers the motor when the difference reaches or exceeds a predetermined threshold; and wherein the controller is further adapted to:

repetitively obtaining electrical power source output values during powering of the motor;

repetitively determine dispense sum increments based on the values;

sum the determined dispense sum increments; and de-power the motor when the sum reaches or exceeds a target value, whereby sheet material length is controlled to a desired length.

21. The dispenser of claim 20 wherein the proximity detector comprises:

a sensor element having a capacitance;

an oscillator operatively connected to the sensor and having an oscillating voltage output the frequency of which changes based on changes in the capacitance; and a frequency divider operatively connected to the oscillator and constructed to convert the oscillating voltage output into a logical-level square wave.

22. The dispenser of claim 21 wherein the oscillator further includes:

an idle-state oscillating voltage output having a frequency range; and a detection-state oscillating voltage output having a frequency range less than the idle-state oscillating voltage output frequency range.

23. The dispenser of claim 21 wherein the frequency divider is adapted to divide the frequency of the oscillating voltage output by a predetermined value as the frequency divider generates the logical-level square wave.

24. The dispenser of claim 23 wherein the logical-level square wave has a nominal frequency of about 1.5 kHz.

25. The dispenser of claim 23 wherein the controller has a clock signal having a clock frequency and wherein the output signal is a stream of numerical values, each numerical value being equal to the number of clock frequency cycles in a fixed number of logical-level square wave cycles.

26. The dispenser of claim 23 wherein the power source output values comprise a power source voltage $V_s$ and a motor current-sensing voltage $V_{curr}$ and the instructions are adapted to repetitively obtain the voltages.

27. The dispenser of claim 26 wherein each dispense sum increment is determined according to the formula, the power source voltage $V_s$ minus three times motor current-sensing voltage $V_{curr}$, and the instructions are adapted to repetitively determine the dispense sum increments.

28. The dispenser of claim 27 wherein the instructions are adapted to sequentially sum the determined dispense sum increments and to de-power the motor when the sum reaches the target value.

29. The dispenser of claim 28 wherein:

the power source comprises at least one battery having a life cycle and a voltage which decreases during the life cycle;

the dispense sum increment decreases as the voltage decreases during the battery life cycle; and as the dispense sum increment decreases, the number of summing operations required to reach the target value are increased, said increased number of summing operations resulting in an increased time duration to reach the target value, thereby compensating for the voltage decrease by powering the motor for the increased time duration.

30. The dispenser of claim 29 wherein the controller further includes a sheet material length selecting circuit and the selecting circuit is used to select from among a plurality of predetermined target values, each target value corresponding to one predetermined sheet material length.

31. The dispenser of claim 30 wherein the instructions are further adapted to compensate for coasting of the dispensing mechanism occurring after motor de-powering, said instructions multiplying a portion of the dispense sum increments by a factor determined by comparing dispense sum increments to an inertia threshold.

32. The dispenser of claim 31 wherein:

the factor is applied when the sum of the dispense sum increments reaches a dispense sum threshold; and the factor is varied such that if the dispense sum increment is above the inertia threshold, the motor is de-powered earlier in the dispense cycle and if the dispense sum increment is below the inertia threshold, the motor is de-powered later in the dispense cycle, whereby dispensing mechanism coasting is estimated in a determination of when to de-power the motor.

33. A method of controlling operation of an automatic product dispenser to detect a user without direct physical contact between the user and the dispenser, the method comprising:

sensing a user proximate the dispenser and without direct physical contact between the user and the dispenser;

generating an output signal responsive to sensing of the user;

receiving the output signal with a first digital low-pass filter residing in instructions in a micro-controller memory, said first filter having a time constant and providing a first output;

receiving the output signal with a second digital low-pass filter residing in instructions in the micro-controller memory, said second filter having a time constant different than the first filter time constant and providing a second output;

differencing the first and second outputs with the micro-controller instructions; and dispensing product from the dispenser responsive to the difference.

34. The method of claim 33 wherein sensing a user comprises changing a sensor element capacitance responsive to the user proximate the dispenser.

35. The method of claim 34 wherein generating an output signal comprises:

changing an oscillating voltage output frequency responsive to the change in sensor element capacitance; and converting the oscillating voltage output to a logical-level square wave.

36. The method of claim 35 wherein changing an oscillating voltage output frequency comprises:

providing an idle-state oscillating voltage output when a user is not proximate the dispenser, said idle-state voltage output having a frequency range; and providing a detection-state oscillating voltage output when the user is proximate the dispenser, said detection-state oscillating voltage output having a frequency range less than the idle-state oscillating voltage output frequency range.

37. The method of claim 35 wherein generating an output signal further comprises:

repetitively counting a clock oscillator signal for a fixed number of logical square-wave cycles to provide a counted value; and forming a sequential stream of numerical values, each numerical value being equal to the counted value.

38. The method of claim 33 wherein dispensing product from the dispenser further comprises dispensing a product selected from one or more of the group consisting of towel, tissue, wipes, sheet-form materials, soap, shaving cream, fragrances and personal care products.

39. The method of claim 33 wherein dispensing product from the dispenser responsive to the difference comprises dispensing product when the difference reaches a predetermined threshold.

40. The method of claim 39 wherein dispensing product from the dispenser responsive to the difference further comprises powering a dispensing mechanism with the micro-controller when the difference reaches the predetermined threshold.

41. A method of controlling operation of an electronic sheet material dispenser such that the dispenser dispenses a preselected length of sheet material, the method comprising:

powering a drive motor in response to a request for sheet material;

dispensing a length of sheet material with a dispensing mechanism powered by the drive motor;

repetitively obtaining electrical power source output values during powering of the motor;

performing mathematical operations using the values to produce a computed value; and de-powering the drive motor when the computed value reaches a target value corresponding a desired length of sheet material, whereby sheet material length is controlled to the desired length.

42. The method of claim 41 wherein repetitively obtaining the electrical power source output values comprises sequentially obtaining a plurality of values of power source voltage $V_s$ and motor current-sensing voltage $V_{curr}$.

43. The method of claim 42 wherein performing mathematical operations using the values comprises:

repetitively determining dispense sum increments based on the values; and sequentially summing the dispense sum increments to produce a dispense sum.

44. The method of claim 43 wherein determining the dispense sum increments comprises determining dispense sum increments Q according to the formula, the power source voltage $V_s$ minus three times motor current-sensing voltage $V_{curr}$, and the step of de-powering the drive motor includes de-powering the drive motor when the dispense sum reaches the target value.

45. The method of claim 44 further comprising, before powering the drive motor:

selecting a predetermined sheet material length from among a plurality of predetermined sheet material lengths; and setting the target value based on the selected predetermined sheet material length.

46. The method of claim 45 further comprising compensating for coasting of the dispensing mechanism occurring after motor de-powering.

47. The method of claim 46 wherein compensating for coasting of the dispensing mechanism comprises multiplying a portion of the dispense sum increments by a factor determined by comparing dispense sum increments to an inertia threshold.

48. The method of claim 47 further comprising:

applying the factor when the sum of the dispense sum increments reaches a dispense sum threshold; and setting the factor such that, if the dispense sum increment is above the inertia threshold, the motor is de-powered earlier in the dispense cycle and if the dispense sum increment is below the inertia threshold, the motor is de-powered later in the dispense cycle, whereby the coasting is estimated in a determination of when to de-power the motor.

* * * * *